US011613798B2

(12) United States Patent
Kaup et al.

(10) Patent No.: US 11,613,798 B2
(45) Date of Patent: Mar. 28, 2023

(54) PACKAGING SHEET METAL PRODUCT

(71) Applicant: thyssenkrupp Rasselstein GmbH, Andernach (DE)

(72) Inventors: Burkhard Kaup, Andernach (DE); Luisa-Marie Heine, Koblenz (DE); Blaise Massicot, Burgbrohl (DE)

(73) Assignee: thyssenkrupp Rasseistein GmbH, Andernach (DE)

( * ) Notice: Subject to any disclaimer, the term of this patent is extended or adjusted under 35 U.S.C. 154(b) by 67 days.

(21) Appl. No.: 17/193,477

(22) Filed: Mar. 5, 2021

(65) Prior Publication Data

US 2021/0277505 A1 Sep. 9, 2021

(30) Foreign Application Priority Data

Mar. 6, 2020 (DE) ..... 10 2020 106 164.1
Oct. 8, 2020 (DE) ..... 10 2020 126 437.2

(51) Int. Cl.

| | |
|---|---|
| ***C22C 38/04*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |

(52) U.S. Cl.

CPC ..... *C22C 38/04* (2013.01); *C21D 8/0205* (2013.01); *C21D 8/0236* (2013.01); *C22C 38/004* (2013.01); *C22C 38/02* (2013.01); *C22C 38/06* (2013.01); *C21D 2211/003* (2013.01); *C21D 2211/005* (2013.01)

(58) Field of Classification Search

None

See application file for complete search history.

(56) References Cited

FOREIGN PATENT DOCUMENTS

WO WO-2005068667 A1 * 7/2005 ..... C21D 8/0257

* cited by examiner

*Primary Examiner* — Anthony M Liang

(74) *Attorney, Agent, or Firm* — Paul D. Bianco; Katharine Davis Wong; Fleit Intellectual Property Law

(57) ABSTRACT

A packaging sheet metal product from a cold-rolled steel sheet with a thickness of less than 0.6 mm has a specified composition. The packaging sheet metal product during biaxial deformation in a bulge test has a lower yield strength ($Sb_{eL}$) of more than 300 MPa and a corresponding elongation at break (Ab) of more than 10% and in the plastic region between the Lüders elongation ($Ab_e$) and an upper (plastic) elongation limit of $\varepsilon_{max}=0.5\cdot Ab\cdot(Sb_{eL}/Sb_m)$ has a biaxial stress/strain diagram $\sigma_B(\varepsilon)$ that can be represented by a function $\varepsilon_B=b\cdot\varepsilon^n$, with: $\sigma_B$ is the true biaxial stress in MPa; ε is the amount of true elongation in the thickness direction in %; $Sb_m$ is the absolute strength; b is a proportionality factor; and n is a strain-hardening exponent. A strengthening of the packaging sheet product in the thickness direction is characterized by a strain-hardening exponent of $n\geq 0.353-5.1\cdot Sb_{eL}/10^4$ MPa.

20 Claims, 16 Drawing Sheets

| Variable | Value from example curve |
|---|---|
| $Sb_m$ | 584 MPa |
| $Sb_{eH}$ | 494 MPa |
| $Sb_{eL}$ | 440 MPa |
| Ab | 27.8 % |
| $Ab_e$ | 2.4 % |

| Variable | Value from example curve |
|---|---|
| $Sb_m$ | 584 MPa |
| $Sb_{eH}$ | 494 MPa |
| $Sb_{eL}$ | 440 MPa |
| Ab | 27.8 % |
| $Ab_e$ | 2.4 % |

Table 1

| Variable | Upper yield strength | Lower yield strength | Absolute strength | Lüders elongation | Elongation at break | Upper elongation limit | Strain-hardening coefficient | Proportionality factor |
|---|---|---|---|---|---|---|---|---|
| Tensile test | $R_{eH}$ | $R_{eL}$ | $R_m$ | ca. $A_e$ | A | - | - | - |
| Bulge test | $Sb_{eH}$ | $Sb_{eL}$ | $Sb_m$ | $Ab_e$ | Ab | $\varepsilon_{max}$ | n | b |
| Description for bulge test | Highest biaxial true stress before the first distinct stress decline into the discontinuous region | Smallest biaxial true stress in the discontinuous region during plastic flow | Highest biaxial true stress after the discontinuous region and right before rupture | Remaining true elongation in the thickness direction in the transition between the discontinuous and subsequent continuous region | Maximum remaining true elongation in the thickness direction right before rupture | Amount of true elongation in the thickness direction that is stated as a function of elongation at break, absolute strength and lower yield stress | Exponent of a power function that describes the curve profile between Lüders elongation and upper yield stress | Multiplicative factor of a power function that describes the curve profile between Lüders elongation and upper yield stress |

Fig. 8

| No. | Category | C [%] | N [%] | Mn [%] | P [%] | S [%] | Si [%] | Ni [%] | Cr [%] | Al [%] | Cu [%] | Mo [%] | Ti [%] | Nb [%] | $N_0$ [%] |
|---|---|---|---|---|---|---|---|---|---|---|---|---|---|---|---|
| 1 | not according to the invention | 0,0016 | 0,0016 | 0,1900 | 0,0080 | 0,0070 | 0,0070 | 0,0130 | 0,0140 | 0,0020 | 0,0290 | 0,0090 | 0,0008 | 0,0007 | 0,0016 |
| 2 | not according to the invention | 0,0017 | 0,0020 | 0,2300 | 0,0100 | 0,0040 | 0,0130 | 0,0150 | 0,0230 | 0,0020 | 0,0060 | 0,0020 | 0,0004 | 0,0007 | 0,0020 |
| 3 | not according to the invention | 0,0017 | 0,0020 | 0,2300 | 0,0100 | 0,0040 | 0,0130 | 0,0150 | 0,0230 | 0,0020 | 0,0060 | 0,0020 | 0,0004 | 0,0009 | 0,0020 |
| 4 | not according to the invention | 0,0017 | 0,0020 | 0,2300 | 0,0100 | 0,0040 | 0,0130 | 0,0150 | 0,0230 | 0,0020 | 0,0060 | 0,0020 | 0,0004 | 0,0004 | 0,0020 |
| 5 | not according to the invention | 0,0017 | 0,0020 | 0,2300 | 0,0100 | 0,0040 | 0,0130 | 0,0150 | 0,0230 | 0,0020 | 0,0060 | 0,0020 | 0,0004 | 0,0008 | 0,0020 |
| 6 | not according to the invention | 0,0017 | 0,0020 | 0,2300 | 0,0100 | 0,0040 | 0,0130 | 0,0150 | 0,0230 | 0,0020 | 0,0060 | 0,0020 | 0,0004 | 0,0007 | 0,0020 |
| 7 | not according to the invention | 0,0017 | 0,0018 | 0,2200 | 0,0120 | 0,0040 | 0,0100 | 0,0260 | 0,0210 | 0,0270 | 0,0090 | 0,0040 | 0,0004 | 0,0008 | 0,0018 |
| 8 | according to the invention | 0,0018 | 0,0430 | 0,2000 | 0,0070 | 0,0263 | 0,0070 | 0,0290 | 0,0180 | 0,0020 | 0,0100 | 0,0110 | 0,0006 | 0,0009 | 0,0022 |
| 9 | according to the invention | 0,0019 | 0,0041 | 0,2200 | 0,0090 | 0,0040 | 0,0160 | 0,0160 | 0,0190 | 0,0010 | 0,0070 | 0,0020 | 0,0010 | 0,0010 | 0,0017 |
| 10 | according to the invention | 0,0019 | 0,0041 | 0,2200 | 0,0090 | 0,0040 | 0,0160 | 0,0160 | 0,0190 | 0,0010 | 0,0070 | 0,0020 | 0,0010 | 0,0008 | 0,0017 |
| 11 | according to the invention | 0,0019 | 0,0041 | 0,2200 | 0,0090 | 0,0040 | 0,0160 | 0,0160 | 0,0190 | 0,0010 | 0,0070 | 0,0020 | 0,0010 | 0,0010 | 0,0017 |
| 12 | not according to the invention | 0,0019 | 0,0041 | 0,2200 | 0,0090 | 0,0040 | 0,0160 | 0,0160 | 0,0190 | 0,0010 | 0,0070 | 0,0020 | 0,0010 | 0,0010 | 0,0017 |
| 13 | not according to the invention | 0,0021 | 0,0016 | 0,2400 | 0,0110 | 0,0050 | 0,0230 | 0,0180 | 0,0350 | 0,0020 | 0,0070 | 0,0040 | 0,0004 | 0,0010 | 0,0016 |
| 14 | not according to the invention | 0,0022 | 0,0031 | 0,2200 | 0,0090 | 0,0050 | 0,0170 | 0,0380 | 0,0280 | 0,0010 | 0,0120 | 0,0070 | 0,0010 | 0,0010 | 0,0031 |
| 15 | not according to the invention | 0,0022 | 0,0031 | 0,2200 | 0,0090 | 0,0050 | 0,0170 | 0,0380 | 0,0280 | 0,0010 | 0,0120 | 0,0070 | 0,0010 | 0,0010 | 0,0031 |
| 16 | not according to the invention | 0,0022 | 0,0031 | 0,2200 | 0,0090 | 0,0050 | 0,0170 | 0,0380 | 0,0280 | 0,0010 | 0,0120 | 0,0070 | 0,0010 | 0,0010 | 0,0031 |
| 17 | not according to the invention | 0,0022 | 0,0031 | 0,2200 | 0,0090 | 0,0050 | 0,0170 | 0,0380 | 0,0280 | 0,0010 | 0,0120 | 0,0070 | 0,0010 | 0,0010 | 0,0031 |
| 18 | according to the invention | 0,0024 | 0,0052 | 0,2300 | 0,0110 | 0,0050 | 0,0190 | 0,0160 | 0,0210 | 0,0010 | 0,0070 | 0,0030 | 0,0010 | 0,0007 | 0,0022 |
| 19 | according to the invention | 0,0024 | 0,0136 | 0,2300 | 0,0100 | 0,0050 | 0,0250 | 0,0150 | 0,0210 | 0,0010 | 0,0120 | 0,0040 | 0,0005 | 0,0005 | 0,0022 |
| 20 | according to the invention | 0,0024 | 0,0052 | 0,2300 | 0,0110 | 0,0050 | 0,0190 | 0,0160 | 0,0210 | 0,0010 | 0,0070 | 0,0030 | 0,0010 | 0,0010 | 0,0022 |
| 21 | according to the invention | 0,0024 | 0,0052 | 0,2300 | 0,0110 | 0,0050 | 0,0190 | 0,0160 | 0,0210 | 0,0010 | 0,0070 | 0,0030 | 0,0010 | 0,0011 | 0,0022 |
| 22 | not according to the invention | 0,0027 | 0,0020 | 0,2300 | 0,0110 | 0,0050 | 0,0250 | 0,0130 | 0,0240 | 0,0020 | 0,0070 | 0,0020 | 0,0004 | 0,0013 | 0,0020 |
| 23 | not according to the invention | 0,0029 | 0,0021 | 0,2300 | 0,0100 | 0,0050 | 0,0270 | 0,0150 | 0,0210 | 0,0020 | 0,0120 | 0,0040 | 0,0005 | 0,0005 | 0,0021 |
| 24 | according to the invention | 0,0030 | 0,0119 | 0,2400 | 0,0080 | 0,0040 | 0,0210 | 0,0180 | 0,0220 | 0,0020 | 0,0060 | 0,0020 | 0,0004 | 0,0005 | 0,0017 |
| 25 | according to the invention | 0,0041 | 0,0050 | 0,1800 | 0,0110 | 0,0194 | 0,0140 | 0,0540 | 0,0120 | 0,0260 | 0,0220 | 0,0140 | 0,0005 | 0,0008 | 0,0020 |
| 26 | not according to the invention | 0,0064 | 0,0025 | 0,1900 | 0,0100 | 0,0250 | 0,0280 | 0,0320 | 0,0180 | 0,0010 | 0,0090 | 0,0010 | 0,0005 | 0,0008 | 0,0025 |
| 27 | according to the invention | 0,0080 | 0,0050 | 0,1700 | 0,0110 | 0,0250 | 0,0060 | 0,0180 | 0,0140 | 0,0280 | 0,0210 | 0,0180 | 0,0006 | 0,0005 | 0,0018 |
| 28 | according to the invention | 0,0120 | 0,0090 | 0,1900 | 0,0140 | 0,0210 | 0,0160 | 0,0170 | 0,0190 | 0,0340 | 0,0290 | 0,0090 | 0,0028 | 0,0016 | 0,0024 |
| 29 | not according to the invention | 0,0120 | 0,0022 | 0,2300 | 0,0150 | 0,0060 | 0,0090 | 0,0130 | 0,0230 | 0,0370 | 0,0080 | 0,0140 | 0,0004 | 0,0023 | 0,0022 |
| 30 | according to the invention | 0,0130 | 0,0210 | 0,1800 | 0,0070 | 0,0220 | 0,0150 | 0,0140 | 0,0150 | 0,0410 | 0,0160 | 0,0030 | 0,0006 | 0,0005 | 0,0045 |
| 31 | according to the invention | 0,0140 | 0,0080 | 0,2100 | 0,0090 | 0,0028 | 0,0160 | 0,0150 | 0,0230 | 0,0270 | 0,0080 | 0,0030 | 0,0060 | 0,0010 | 0,0034 |
| 32 | according to the invention | 0,0140 | 0,0080 | 0,2100 | 0,0090 | 0,0016 | 0,0024 | 0,0150 | 0,0230 | 0,0270 | 0,0080 | 0,0030 | 0,0060 | 0,0010 | 0,0034 |
| 33 | not according to the invention | 0,0140 | 0,0080 | 0,2100 | 0,0090 | 0,0430 | 0,0160 | 0,0150 | 0,0230 | 0,0270 | 0,0080 | 0,0030 | 0,0060 | 0,0010 | 0,0034 |
| 34 | according to the invention | 0,0170 | 0,0420 | 0,2000 | 0,0080 | 0,0280 | 0,0190 | 0,0230 | 0,0200 | 0,0140 | 0,0220 | 0,0180 | 0,0004 | 0,0008 | 0,0043 |
| 35 | according to the invention | 0,0210 | 0,0120 | 0,2200 | 0,0100 | 0,0290 | 0,0230 | 0,0350 | 0,0130 | 0,0170 | 0,0120 | 0,0180 | 0,0007 | 0,0007 | 0,0037 |

Table 2A

Fig. 9

| No. | Category | C [%] | N [%] | Mn [%] | P [%] | S [%] | Si [%] | Ni [%] | Cr [%] | Al [%] | Cu [%] | Mo [%] | Ti [%] | Nb [%] | $N_0$ [%] |
|---|---|---|---|---|---|---|---|---|---|---|---|---|---|---|---|
| 36 | not according to the invention | 0,0210 | 0,0021 | 0,2500 | 0,0140 | 0,0260 | 0,0060 | 0,0170 | 0,0230 | 0,0450 | 0,0090 | 0,0040 | 0,0007 | 0,0009 | 0,0021 |
| 37 | according to the invention | 0,0240 | 0,0170 | 0,2300 | 0,0200 | 0,0260 | 0,0260 | 0,0160 | 0,0170 | 0,0450 | 0,0250 | 0,0180 | 0,0007 | 0,0008 | 0,0028 |
| 38 | not according to the invention | 0,0280 | 0,0026 | 0,2100 | 0,0200 | 0,0120 | 0,0280 | 0,0120 | 0,0210 | 0,0460 | 0,0150 | 0,0070 | 0,0008 | 0,0010 | 0,0026 |
| 39 | according to the invention | 0,0290 | 0,0230 | 0,2200 | 0,0080 | 0,0250 | 0,0240 | 0,0450 | 0,0210 | 0,0470 | 0,0240 | 0,0060 | 0,0007 | 0,0023 | 0,0027 |
| 40 | according to the invention | 0,0320 | 0,0140 | 0,2800 | 0,0110 | 0,0090 | 0,0290 | 0,0330 | 0,0340 | 0,0380 | 0,0160 | 0,0040 | 0,0006 | 0,0006 | 0,0047 |
| 41 | according to the invention | 0,0330 | 0,0180 | 0,2300 | 0,0120 | 0,0060 | 0,0090 | 0,0160 | 0,0260 | 0,0330 | 0,0080 | 0,0030 | 0,0010 | 0,0009 | 0,0039 |
| 42 | not according to the invention | 0,0340 | 0,0041 | 0,2500 | 0,0090 | 0,0130 | 0,0130 | 0,0180 | 0,0260 | 0,0360 | 0,0100 | 0,0030 | 0,0007 | 0,0010 | 0,0041 |
| 43 | not according to the invention | 0,0350 | 0,0046 | 0,2300 | 0,0140 | 0,0070 | 0,0130 | 0,0190 | 0,0320 | 0,0370 | 0,0090 | 0,0030 | 0,0008 | 0,0009 | 0,0046 |
| 44 | according to the invention | 0,0360 | 0,0180 | 0,2200 | 0,0140 | 0,0070 | 0,0100 | 0,0150 | 0,0240 | 0,0350 | 0,0070 | 0,0020 | 0,0007 | 0,0010 | 0,0048 |
| 45 | not according to the invention | 0,0360 | 0,0028 | 0,2300 | 0,0150 | 0,0100 | 0,0060 | 0,0150 | 0,0260 | 0,0460 | 0,0090 | 0,0020 | 0,0007 | 0,0007 | 0,0028 |
| 46 | not according to the invention | 0,0360 | 0,0028 | 0,2300 | 0,0150 | 0,0100 | 0,0060 | 0,0150 | 0,0260 | 0,0460 | 0,0090 | 0,0020 | 0,0007 | 0,0010 | 0,0028 |
| 47 | not according to the invention | 0,0360 | 0,0028 | 0,2300 | 0,0150 | 0,0100 | 0,0060 | 0,0150 | 0,0260 | 0,0460 | 0,0090 | 0,0020 | 0,0007 | 0,0010 | 0,0028 |
| 48 | not according to the invention | 0,0360 | 0,0028 | 0,2300 | 0,0150 | 0,0100 | 0,0060 | 0,0150 | 0,0260 | 0,0460 | 0,0090 | 0,0020 | 0,0007 | 0,0002 | 0,0028 |
| 49 | according to the invention | 0,0370 | 0,0200 | 0,2400 | 0,0180 | 0,0070 | 0,0170 | 0,0190 | 0,0290 | 0,0280 | 0,0110 | 0,0030 | 0,0009 | 0,0005 | 0,0043 |
| 50 | according to the invention | 0,0380 | 0,0176 | 0,2300 | 0,0130 | 0,0060 | 0,0130 | 0,0170 | 0,0260 | 0,0330 | 0,0090 | 0,0030 | 0,0007 | 0,0008 | 0,0039 |
| 51 | according to the invention | 0,0380 | 0,0215 | 0,2400 | 0,0100 | 0,0060 | 0,0100 | 0,0150 | 0,0220 | 0,0260 | 0,0080 | 0,0010 | 0,0007 | 0,0008 | 0,0041 |
| 52 | not according to the invention | 0,0380 | 0,0037 | 0,2500 | 0,0110 | 0,0060 | 0,0070 | 0,0160 | 0,0290 | 0,0390 | 0,0090 | 0,0030 | 0,0004 | 0,0011 | 0,0037 |
| 53 | according to the invention | 0,0410 | 0,0139 | 0,2300 | 0,0100 | 0,0060 | 0,0110 | 0,0150 | 0,0210 | 0,0390 | 0,0160 | 0,0010 | 0,0008 | 0,0010 | 0,0032 |
| 54 | according to the invention | 0,0410 | 0,0139 | 0,2300 | 0,0100 | 0,0060 | 0,0110 | 0,0150 | 0,0210 | 0,0390 | 0,0160 | 0,0010 | 0,0008 | 0,0010 | 0,0032 |
| 55 | according to the invention | 0,0430 | 0,0133 | 0,2800 | 0,0080 | 0,0060 | 0,0110 | 0,0180 | 0,0250 | 0,0290 | 0,0080 | 0,0010 | 0,0007 | 0,0010 | 0,0035 |
| 56 | according to the invention | 0,0440 | 0,0180 | 0,2300 | 0,0130 | 0,0040 | 0,0130 | 0,0180 | 0,0270 | 0,0320 | 0,0140 | 0,0020 | 0,0010 | 0,0006 | 0,0045 |
| 57 | not according to the invention | 0,0440 | 0,0043 | 0,2400 | 0,0080 | 0,0120 | 0,0090 | 0,0150 | 0,0180 | 0,0450 | 0,0150 | 0,0010 | 0,0005 | 0,0005 | 0,0043 |
| 58 | not according to the invention | 0,0470 | 0,0038 | 0,2300 | 0,0090 | 0,0110 | 0,0210 | 0,0190 | 0,0310 | 0,0270 | 0,0180 | 0,0140 | 0,0008 | 0,0014 | 0,0038 |
| 59 | not according to the invention | 0,0480 | 0,0046 | 0,2400 | 0,0370 | 0,0140 | 0,0300 | 0,0570 | 0,0270 | 0,0360 | 0,0060 | 0,0040 | 0,0043 | 0,0013 | 0,0046 |
| 60 | according to the invention | 0,0490 | 0,0142 | 0,2500 | 0,0070 | 0,0060 | 0,0090 | 0,0180 | 0,0220 | 0,0440 | 0,0070 | 0,0010 | 0,0023 | 0,0010 | 0,0037 |
| 61 | according to the invention | 0,0490 | 0,0280 | 0,2100 | 0,0240 | 0,0020 | 0,0090 | 0,0200 | 0,0410 | 0,0270 | 0,0110 | 0,0030 | 0,0015 | 0,0007 | 0,0029 |
| 62 | not according to the invention | 0,0520 | 0,0052 | 0,1600 | 0,0140 | 0,0220 | 0,0023 | 0,0130 | 0,0230 | 0,0470 | 0,0130 | 0,0130 | 0,0009 | 0,0006 | 0,0052 |
| 63 | according to the invention | 0,0530 | 0,0490 | 0,4300 | 0,0100 | 0,0280 | 0,0270 | 0,0120 | 0,0260 | 0,0490 | 0,0030 | 0,0070 | 0,0005 | 0,0008 | 0,0057 |
| 64 | according to the invention | 0,0530 | 0,0540 | 0,4800 | 0,0150 | 0,0180 | 0,0270 | 0,0280 | 0,0330 | 0,0390 | 0,0300 | 0,0080 | 0,0005 | 0,0013 | 0,0063 |
| 65 | according to the invention | 0,0540 | 0,0570 | 0,5000 | 0,0280 | 0,0090 | 0,0220 | 0,0420 | 0,0430 | 0,0180 | 0,0130 | 0,0010 | 0,0004 | 0,0009 | 0,0023 |
| 66 | not according to the invention | 0,0560 | 0,0057 | 0,1600 | 0,0130 | 0,0260 | 0,0140 | 0,0200 | 0,0280 | 0,0430 | 0,0230 | 0,0150 | 0,0010 | 0,0010 | 0,0057 |
| 67 | according to the invention | 0,0570 | 0,0310 | 0,3400 | 0,0270 | 0,0130 | 0,0090 | 0,0110 | 0,0310 | 0,0260 | 0,0190 | 0,0010 | 0,0031 | 0,0009 | 0,0067 |
| 68 | not according to the invention | 0,0580 | 0,0037 | 0,3500 | 0,0110 | 0,0090 | 0,0080 | 0,0236 | 0,0240 | 0,0290 | 0,0180 | 0,0050 | 0,0005 | 0,0005 | 0,0037 |
| 69 | according to the invention | 0,0590 | 0,0101 | 0,3700 | 0,0230 | 0,0280 | 0,0120 | 0,0180 | 0,0480 | 0,0210 | 0,0200 | 0,0050 | 0,0007 | 0,0005 | 0,0048 |
| 70 | not according to the invention | 0,0710 | 0,0087 | 0,2500 | 0,0180 | 0,0030 | 0,0270 | 0,0150 | 0,0280 | 0,0460 | 0,0200 | 0,0180 | 0,0027 | 0,0007 | 0,0087 |

Table 2B

Fig. 10

| No. | Category | Thickness [mm] | NWG [%] | $Sb_{et1}$ [MPa] | $Sb_{et.}$ [MPa] | $Sb_m$ [MPa] | $Ab_c$ [%] | Ab [%] | b [MPa] | n [1] |
|---|---|---|---|---|---|---|---|---|---|---|
| 1 | not according to the invention | 0,48 | 0,4 | 351 | 276 | 494 | 1,7 | 42,3 | 264 | 0,201 |
| 2 | not according to the invention | 0,30 | 1 | 331 | 286 | 493 | 1,9 | 38,0 | 243 | 0,199 |
| 3 | not according to the invention | 0,22 | 7,5 | 390 | 350 | 536 | 0,7 | 39,0 | 371 | 0,095 |
| 4 | not according to the invention | 0,27 | 10 | 413 | 372 | 465 | 1,1 | 31,4 | 371 | 0,114 |
| 5 | not according to the invention | 0,25 | 15 | 464 | 435 | 487 | 0,8 | 27,3 | 443 | 0,061 |
| 6 | not according to the invention | 0,24 | 20 | 486 | 465 | 494 | 0,8 | 17,3 | 470 | 0,045 |
| 7 | not according to the invention | 0,20 | 0,4 | 364 | 291 | 501 | 1,8 | 39,4 | 279 | 0,183 |
| 8 | according to the invention | 0,17 | 0,6 | 387 | 315 | 541 | 4,1 | 42,7 | 264 | 0,201 |
| 9 | according to the invention | 0,22 | 1 | 409 | 317 | 557 | 2,7 | 41,8 | 257 | 0,215 |
| 10 | according to the invention | 0,19 | 10 | 486 | 454 | 587 | 2,1 | 28,7 | 404 | 0,128 |
| 11 | according to the invention | 0,18 | 15 | 537 | 486 | 594 | 1,6 | 21,6 | 471 | 0,114 |
| 12 | not according to the invention | 0,13 | 40 | 693 | 662 | 675 | 1,6 | 9,3 | 657 | 0,022 |
| 13 | not according to the invention | 0,22 | 6 | 417 | 367 | 566 | 1,3 | 42,8 | 356 | 0,130 |
| 14 | not according to the invention | 0,23 | 1 | 402 | 313 | 551 | 1,6 | 46,0 | 272 | 0,179 |
| 15 | not according to the invention | 0,21 | 10 | 490 | 425 | 581 | 1,8 | 33,5 | 409 | 0,108 |
| 16 | not according to the invention | 0,20 | 15 | 545 | 477 | 588 | 1,7 | 26,8 | 478 | 0,068 |
| 17 | not according to the invention | 0,14 | 40 | 685 | 640 | 645 | 1,4 | 10,5 | 650 | 0,013 |
| 18 | according to the invention | 0,22 | 1 | 405 | 341 | 591 | 2,5 | 41,1 | 283 | 0,207 |
| 19 | according to the invention | 0,21 | 4,5 | 463 | 421 | 656 | 1,3 | 32,9 | 395 | 0,163 |
| 20 | according to the invention | 0,20 | 8 | 548 | 496 | 663 | 2,0 | 26,0 | 455 | 0,126 |
| 21 | according to the invention | 0,18 | 16 | 551 | 502 | 629 | 1,4 | 21,8 | 481 | 0,100 |
| 22 | not according to the invention | 0,17 | 40 | 673 | 651 | 692 | 1,0 | 10,8 | 670 | 0,011 |
| 23 | not according to the invention | 0,21 | 4,5 | 424 | 405 | 580 | 1,5 | 42,6 | 351 | 0,141 |
| 24 | according to the invention | 0,18 | 5 | 472 | 428 | 645 | 1,9 | 36,4 | 376 | 0,163 |
| 25 | according to the invention | 0,28 | 0,6 | 444 | 354 | 514 | 3,4 | 43,1 | 375 | 0,177 |
| 26 | not according to the invention | 0,18 | 2 | 402 | 329 | 532 | 1,8 | 36,6 | 308 | 0,153 |
| 27 | according to the invention | 0,32 | 0,4 | 441 | 347 | 578 | 2,5 | 36,5 | 309 | 0,183 |
| 28 | according to the invention | 0,29 | 0,4 | 459 | 393 | 604 | 2,3 | 35,8 | 337 | 0,170 |
| 29 | not according to the invention | 0,29 | 1 | 410 | 337 | 534 | 1,9 | 36,9 | 307 | 0,163 |
| 30 | according to the invention | 0,14 | 4,5 | 501 | 472 | 682 | 1,3 | 32,1 | 438 | 0,160 |
| 31 | according to the invention | 0,48 | 0,6 | 451 | 375 | 597 | 2,1 | 36,7 | 337 | 0,174 |
| 32 | according to the invention | 0,23 | 20 | 611 | 561 | 658 | 1,9 | 17,9 | 546 | 0,075 |
| 33 | not according to the invention | 0,45 | 33 | 717 | 683 | 698 | 0,8 | 5,4 | 694 | 0,031 |
| 34 | according to the invention | 0,16 | 1 | 461 | 447 | 692 | 1,3 | 37,4 | 432 | 0,183 |
| 35 | according to the invention | 0,15 | 11 | 567 | 514 | 661 | 2,1 | 25,8 | 478 | 0,118 |

Table 3A

Fig. 11

| No. | Category | Thickness [mm] | NWG [%] | $Sb_{eH}$ [MPa] | $Sb_{et.}$ [MPa] | $Sb_{m}$ [MPa] | $Ab_{c}$ [%] | Ab [%] | b [MPa] | n [1] |
|---|---|---|---|---|---|---|---|---|---|---|
| 36 | not according to the invention | 0,19 | 0,8 | 435 | 347 | 542 | 2,2 | 37,4 | 321 | 0,157 |
| 37 | according to the invention | 0,26 | 20 | 643 | 614 | 715 | 1,5 | 17,1 | 602 | 0,079 |
| 38 | not according to the invention | 0,14 | 4,5 | 483 | 407 | 562 | 1,6 | 32,3 | 376 | 0,109 |
| 39 | according to the invention | 0,34 | 7 | 567 | 538 | 717 | 1,6 | 28,4 | 504 | 0,133 |
| 40 | according to the invention | 0,29 | 0,6 | 523 | 459 | 653 | 2,5 | 34,1 | 401 | 0,149 |
| 41 | according to the invention | 0,17 | 5 | 541 | 498 | 667 | 2,1 | 27,0 | 447 | 0,134 |
| 42 | not according to the invention | 0,16 | 22 | 606 | 588 | 615 | 1,2 | 24,6 | 596 | 0,010 |
| 43 | not according to the invention | 0,22 | 0,8 | 470 | 395 | 588 | 3,2 | 41,6 | 349 | 0,129 |
| 44 | according to the invention | 0,18 | 17 | 657 | 638 | 741 | 1,3 | 20,6 | 623 | 0,072 |
| 45 | not according to the invention | 0,21 | 0,4 | 498 | 370 | 591 | 3,5 | 45,4 | 293 | 0,157 |
| 46 | not according to the invention | 0,21 | 1 | 509 | 401 | 580 | 3,0 | 40,4 | 344 | 0,132 |
| 47 | not according to the invention | 0,20 | 5 | 543 | 486 | 588 | 2,7 | 26,5 | 454 | 0,066 |
| 48 | not according to the invention | 0,18 | 15 | 665 | 571 | 608 | 2,4 | 8,6 | 546 | 0,048 |
| 49 | according to the invention | 0,17 | 10 | 645 | 602 | 762 | 1,5 | 26,6 | 575 | 0,103 |
| 50 | according to the invention | 0,21 | 1,2 | 538 | 483 | 654 | 3,3 | 29,4 | 403 | 0,149 |
| 51 | according to the invention | 0,15 | 8 | 584 | 540 | 631 | 2,3 | 17,8 | 497 | 0,096 |
| 52 | not according to the invention | 0,17 | 10 | 532 | 477 | 601 | 1,2 | 30,9 | 470 | 0,077 |
| 53 | according to the invention | 0,22 | 0,4 | 559 | 430 | 667 | 3,0 | 40,5 | 343 | 0,168 |
| 54 | according to the invention | 0,19 | 15 | 720 | 649 | 703 | 3,3 | 13,3 | 632 | 0,039 |
| 55 | according to the invention | 0,21 | 7,5 | 571 | 531 | 668 | 2,2 | 27,2 | 482 | 0,108 |
| 56 | according to the invention | 0,13 | 8 | 626 | 578 | 677 | 3,0 | 16,6 | 524 | 0,100 |
| 57 | not according to the invention | 0,17 | 10 | 565 | 507 | 597 | 1,7 | 20,0 | 488 | 0,081 |
| 58 | not according to the invention | 0,14 | 11 | 589 | 518 | 615 | 2,4 | 25,2 | 492 | 0,054 |
| 59 | not according to the invention | 0,28 | 2,2 | 525 | 454 | 588 | 2,6 | 32,1 | 401 | 0,104 |
| 60 | according to the invention | 0,21 | 6 | 573 | 522 | 655 | 2,3 | 24,1 | 481 | 0,096 |
| 61 | according to the invention | 0,14 | 0,6 | 581 | 546 | 747 | 1,9 | 31,9 | 498 | 0,137 |
| 62 | not according to the invention | 0,23 | 12 | 601 | 549 | 614 | 1,2 | 23,7 | 499 | 0,060 |
| 63 | according to the invention | 0,24 | 14 | 694 | 682 | 757 | 0,9 | 14,8 | 652 | 0,064 |
| 64 | according to the invention | 0,20 | 1,4 | 601 | 576 | 770 | 1,8 | 31,1 | 537 | 0,154 |
| 65 | according to the invention | 0,23 | 5 | 630 | 608 | 781 | 1,7 | 27,4 | 570 | 0,117 |
| 66 | not according to the invention | 0,35 | 18 | 667 | 607 | 647 | 0,8 | 18,1 | 586 | 0,036 |
| 67 | according to the invention | 0,15 | 8 | 661 | 641 | 793 | 1,6 | 24,4 | 607 | 0,101 |
| 68 | not according to the invention | 0,23 | 15 | 649 | 572 | 630 | 1,3 | 10,5 | 548 | 0,031 |
| 69 | according to the invention | 0,25 | 12 | 682 | 605 | 692 | 3,1 | 21,4 | 553 | 0,068 |
| 70 | not according to the invention | 0,22 | 6 | 624 | 545 | 646 | 2,7 | 27,3 | 503 | 0,054 |

Table 3B

Fig. 12

PACKAGING SHEET METAL PRODUCT

FIELD OF THE INVENTION

The invention concerns a packaging sheet metal product from a cold-rolled steel sheet with a thickness of less than 0.6 mm.

BACKGROUND

Packaging sheet metal products are cold-rolled steel sheets with a thickness of up to 0.6 mm that are used to produce packaging, for example, beverage, food or aerosol cans. Since the packaging sheet metal products are exposed to strong deformations during the production of packaging, for example, in deep drawing or ironing methods, packaging sheet metal products, on the one hand, must have a high deformability. To reduce the weight of the packaging, on the other hand, the thinnest possible steel sheets of high strength are used as packaging sheet metal products, which are brought to the desired end thickness in a single or double cold rolling step from a hot-rolled steel sheet. The total cold reduction (degree of thickness reduction during cold rolling) then generally lies at at least 80%, in which case the hot-rolled steel sheet (hot strip) is cold rolled singly or doubly for thickness reduction. Single-reduced steel sheets (SR) are recrystallization annealed after cold rolling to restore deformability and then optionally rerolled or cold finished with a limited final reduction of less than 5%. In double-reduced steel sheets (DR) a second cold rolling step occurs after recrystallization annealing with final reductions between 5 and 45% in order to bring the steel sheet to a desired final thickness of often less than 0.3 mm.

Since the total cold reduction, i.e., reduction of thickness of a hot-rolled steel by single or double cold rolling to a desired end thickness, is limited for technological and material-specific reasons, a limited thickness of the hot-rolled steel sheet (hot strip) is sought after in order to achieve the lowest possible final thicknesses in the cold-rolled steel sheet. However, limited thicknesses of the hot strip, on the one hand, are disadvantageous for economic reasons and, on the other hand, because of the material defects occurring in the hot strip. In order to be able to produce steel sheets with the lowest possible final thickness of less than 0.6 mm, preferably less than 0.5 mm and especially less than 0.35 mm, from hot strips with ordinary thicknesses by single or double cold rolling, total cold reductions of more than 85% are necessary. However, the total cold reduction of a steel sheet with a stipulated composition cannot be increased to arbitrarily high values for both technological reasons and because of the deformation behavior of the steel sheets required for production of packaging. For example, at unduly high total cold reductions, earing tendency of the cold-rolled steel sheets deteriorates. A steel sheet with a stipulated composition of the steel has a earing tendencydependent on the total cold reduction, which exhibits a minimum ear height on the upper edge of cup formed from the cold-rolled steel sheet at a certain optimal cold reduction.

The optimal total cold reduction (total cold reduction optimum) of cold rolled steel sheets at which they have the smallest possible earing tendency again depends upon the composition of the steel. Steels with relatively low carbon and nitrogen content then have a high total cold reduction optimum. However, carbon and nitrogen contribute to a strength increase of steels, for which reason steels with very low carbon and nitrogen content exhibit only moderate strength. However, packaging with limited thickness having sufficient final stability cannot be produced from steels with only moderate strength.

SUMMARY

With this as a point of departure, an aspect of the invention is to offer a cold-rolled steel sheet for production of packaging that has sufficiently high biaxial strength at the smallest possible thickness and that at the same time exhibits good deformation behavior during multiaxial deformation for production of packaging. The cold-rolled steel sheet should then be produced from a hot-rolled steel sheet (hot strip) by single cold rolling with cold finishing after recrystallization annealing or by double cold rolling with a second cold rolling step after recrystallization annealing under the highest possible total cold reduction, so that hot strips in the unusual thickness range can be used for its production, despite the desired low end thickness of less than 0.6 mm and a preferred end thickness in the range of 0.10 mm to 0.50 mm. The cold-rolled steel sheets of the invention as packaging sheet metal products should then meet the high requirements in multiaxial deformation processes in the production of packaging, such as, in deep drawing or ironing methods, for example, in which case the packaging sheet metal products should withstand especially multiaxial deformations and thinning in the thickness direction without material failure and without compromising the strength of the three-dimensional packaging bodies produced from them.

These problems are solved with a packaging sheet metal product as disclosed herein. Preferred features and properties of the packaging sheet metal products of the invention as well as methods for their production are also disclosed herein. A method for the characterization of packaging sheet metal products according to the invention is further disclosed.

The invention starts from the following considerations:

In the deformation methods for production of packaging from packaging sheet metal products, for example, in deep drawing and ironing methods for production of beverage cans, multiaxial deformation of the packaging sheet metal (cold-rolled steel sheet) occurs with a significant thinning of the original thickness of the packaging sheet metal of less than 0.6 mm locally. For example, the thickness of a packaging sheet metal during deep drawing and ironing of a beverage can is reduced by deformation of the packaging sheet metal by means of deformation dies in the middle section of the can body to about 30% of the original thickness. The occurring material stress is only inadequately characterized by the mechanical properties, like tensile strength and elongation at break, which are determined in uniaxial tensile tests by means of stress/strain diagrams. Optimization of the mechanical properties of packaging sheet metal products according to the characteristics determined in uniaxial tensile tests should not be preferred for this reason.

The invention therefore starts from the fact that the characterization of the mechanical properties of packaging sheet metal products and especially their deformation behavior can be better characterized by multiaxial tensile tests in order to be able to optimize the material properties on this basis. The mechanical properties and the deformation capability of the packaging sheet metal products according to the invention are therefore advantageously recorded with the hydraulic cupping test defined in the DIN EN ISO 16808 standard (according to EN ISO 16808) with optical measurement systems (subsequently also referred to as the bulge test). In the hydraulic cupping test according to standard DIN EN ISO 16808, a biaxial stress/strain curve is determined by means of an optical measurement system on a sample of the steel sheet in which the true biaxial stress during pure stretch forming is recorded via the degree of deformation (amount of true elongation ε in the thickness direction) with consideration of the thickness reduction. For this purpose, a sample of the steel sheet, which is especially present in the form of a round blank, is tightened on its edge between a die and a hold-down and a liquid is then forced against the tightened steel sheet so that a protrusion is formed until a crack occurs in the steel sheet. During the hydraulic cupping test, the pressure of the liquid is measured and the development of deformation of the sheet is recorded with an optical measurement instrument. Based on the recorded sheet deformation, the local curvature, the degree of deformation on the surface and the thickness of the deformed sheet can be recorded. The (true) biaxial stress and the true elongation in the thickness direction can be calculated from the liquid pressure, the thickness and the radius of curvature of the deformed sheet. The biaxial stress/strain curve (flow curve in the biaxial state of stress) is determined from these data. The curve profile of the biaxial stress/strain curve from a bulge test then has a similar curve profile in comparison with a uniaxial tensile test (as defined, for example, in the standard DIN EN ISO 6892-1). However, in the hydraulic cupping test of the bulge test higher shape-change values and especially higher elongations as well as a more pronounced cold hardening are achieved on the same material after the elastic range is overcome.

It is then assumed that, due to the similar curve profiles of the stress/strain curves of the uniaxial tensile test and a bulge test on the same sample, the mechanical characteristics ordinarily determined in the uniaxial tensile test, for example, the absolute strength, the lower and upper yield strength, the elongation at break as well as the Lüders elongation can be assigned accordingly in the biaxial stress/strain curve of the hydraulic cupping test (bulge test). Table 1 shown in FIG. 8 shows the assignment of mechanical characteristics from a uniaxial tensile test and the hydraulic cupping test according to the bulge test. An example of the biaxial stress/strain curve determined from bulge tests of aged steel sheet samples is shown in FIG. 1, in which the true biaxial stress $\sigma_B$ in [MPa] is plotted versus the amount of true elongation in the thickness direction $|\varepsilon|$ in [%], and the recorded mechanical characteristics are stated according to Table 1 and plotted. The true elongation in the thickness direction is negative due to the thickness reduction in the biaxial tensile test of the bulge test. The (true) elongation ε is therefore always understood to be the amount of negative elongation in the thickness direction of the sheet, in which case the thickness reduction is considered in recording the true elongation. The regions of elastic and plastic deformation are shown enlarged in the inserts of FIG. 1.

The mechanical characteristics of a steel sheet sample shown in Table 1 are then determined in a biaxial stress/strain diagram, as shown by the example in FIG. 1, as follows:

The curve of the stress/strain diagram exhibits three characteristic regions in succession on the abscissa:

(1) Elastic region with linear slope of the stress versus elongation:

The upper yield strength $Sb_{eH}$ is interpreted in the local maximum of this line, before the first distinct drop in stress occurs;

(2) Discontinuous curve profile, which marks the transition to or the beginning of the plastic region and in which the stress is approximately constant versus elongation:

The lowest stress within this discontinuous region corresponds to the lower yield strength $Sb_{eL}$, in which transient phenomena are not considered. At the end of the discontinuous region (2) and therefore in the transition to the subsequent, again continuously rising curve profile of region (3), the Lüders elongation $Ab_e$ is determined. For this purpose, a line parallel to the initial line of the elastic region is drawn and the Lüders elongation is read at its intersection with the abscissa. The elastic recovery of the material is therefore not considered.

(3) Plastic region of constant cold hardening in which the stress continuously rises versus elongation up to break:

At the end of the curve profile, on the one hand, the absolute strength $Sb_m$ is determined, which represents the maximum stress at rupture. On the other hand, the elongation at break Ab is interpreted, in which the procedure is similar to determination of the Lüders elongation. A line parallel to the initial line of the elastic region is drawn and the elongation at break read at its intersection with the abscissa. The elastic recovery of the material is therefore not considered here either.

The plastic region of the stress/strain curve of FIG. 1 is show in FIG. 2 in the region between the Lüders elongation $Ab_e$ and an upper (plastic) elongation limit of $\varepsilon_{max}=0.5\cdot Ab\cdot(Sb_{eL}/Sb_m)$, in which Ab is the elongation at break, $Sb_{eL}$ is the lower yield strength and $Sb_m$ is the absolute strength. The plastic region of the stress/strain curve depicted in FIG. 2 can be described by a function $\sigma_B=b\cdot\varepsilon^n$, in which $\sigma_B$ is the true biaxial stress (in MPa), ε the amount of true elongation in the thickness direction (in %), b is a proportionality factor and n is a strain-hardening exponent. In the example of FIG. 2 the elastic-plastic region of the stress/strain curve can be depicted between the Lüders elongation $Ab_e$ and the upper (plastic) elongation limit $\varepsilon_{max}$ by the function $\sigma_B=b\cdot\varepsilon^n$ with b=402 MPa and n=0.132. An appropriate-fit curve is drawn in the stress/strain diagram of FIG. 2.

Starting from these preliminary considerations, the invention concerns:

Packaging sheet metal product from a cold-rolled steel sheet with a thickness of less than 0.6 mm having the following composition, in terms of weight:

C: 0.001-0.06%,
Si: <0.03%, preferably 0.002 to 0.03%,
Mn: 0.17-0.5%,
P: <0.03%, preferably 0.005 to 0.03%,
S: 0.001-0.03%,
Al: 0.001-0.1%,
N: 0.002-0.12%, preferably 0.004 to 0.07%,
optionally Cr: <0.1%, preferably 0.01-0.08%,
optionally Ni: <0.1%, preferably 0.01-0.05%,
optionally Cu: <0.1%, preferably 0.002-0.05%,
optionally Ti: <0.01%,
optionally B: <0.005%,
optionally Nb: <0.01%,
optionally Mo: <0.02%,
optionally Sn: <0.03%,
remainder iron and unavoidable impurities, in which the packaging sheet metal product during biaxial deformation in a bulge test has a lower yield strength ($Sb_{eL}$) of more than 300 MPa and a corresponding elongation at break (Ab) of more than 10% and in the plastic region between the Lüders elongation ($Ab_e$) and an upper (plastic) elongation limit of $\varepsilon_{max}=0.5\cdot Ab\cdot(Sb_{eL}/Sb_m)$ has a biaxial stress/strain diagram $\sigma_B(\varepsilon)$ that can be represented with a function $\sigma_B=b\cdot\varepsilon^n$, in which $\sigma_B$ is the true biaxial stress (in MPa), $\varepsilon$ is the amount of true elongation in the thickness direction (in %), $Sb_{eL}$ is the lower yield strength, $Sb_m$ is the absolute strength, $Ab_e$ is the Lüders elongation, Ab is elongation at break, b is a proportionality factor and n is a strain-hardening exponent, and a strengthening of the packaging sheet metal product in the thickness direction is characterized by a strain-hardening exponent of $$n\geq 0.353-5.1\cdot Sb_{eL}/10^4 \text{ MPa}.$$

Packaging sheet metal products with corresponding properties of a biaxial stress/strain curve determined in the bulge test can be produced by a reduction of the thickness of the steel sheet by single or double cold rolling of a hot strip with a preferred thickness from 2 mm to 4 mm to final thicknesses of less than 0.6 mm and, on the one hand, are characterized by sufficiently high biaxial strength for production of packaging and, on the other hand, have sufficiently high multiaxial deformation capacity, which permits production of packaging in demanding deep drawing methods under multiaxial deformation even with significant thinning of the material in the thickness direction without the occurrence of cracks. Due to the high biaxial strength and the high multiaxial deformation capacity, thinner packaging sheet metal products can be used for production of packaging without fear of compromised stability of the produced packaging. By using thinner packaging sheet metal products, the weight of the packages produced from them can be reduced.

It was shown that these advantageous mechanical properties of the packaging sheet metal products according to the invention, which can be determined by the hydraulic cupping test of the bulge test by recording a biaxial stress/strain curve, on the one hand, can be achieved by the composition of the cold-rolled steel sheets with a low carbon content in the range of 0.001 to 0.06 wt % and, on the other hand, by a high nitrogen content of 0.002 to 0.12 wt %. The nitrogen is then preferably and at least essentially incorporated in the cold-rolled steel sheet by increasing the nitrogen content of the cold-rolled steel sheet in an annealing furnace with a nitrogenizing gas atmosphere, especially an ammonia atmosphere. By increasing the nitrogen content of the steel sheet in the annealing furnace, the introduced nitrogen can be incorporated very uniformly over the cross section of the steel sheet interstitially in the (ferrite) lattice of the steel. The positive properties of the hot-rolled steel sheet (hot strip) can thereby be maintained to retain a high total cold reduction optimum and high solid solution hardening. In particular, the nitrogen content in the hot strip can be kept low and especially less than 0.016 wt %. This ensures that in the production of a slab from the molten steel no slab cracks and pores are formed and that the hot strip produced from the slab by hot rolling does not have unduly high strength and therefore can be cold rolled with the usual rolling equipment with total cold reductions (total reduction ratio of single or double cold rolling) of more than 80%.

The nitrogen incorporated during increasing the nitrogen content of the cold-rolled steel sheet in the annealing furnace can then be introduced homogeneously distributed over the thickness of the steel sheet without the formation of hard and brittle nitride layers on the surfaces of the steel sheet. This can be achieved, in particular, in that increasing the nitrogen content of the cold-rolled steel sheet is conducted in a continuous annealing furnace through which the steel sheet is passed in strip form (i.e., as a cold-rolled steel strip) with a stipulated strip speed of preferably more than 200 m/min, and a nitrogenizing gas, especially ammonia gas is introduced, on the one hand, to form a nitrogen-containing gas atmosphere in the annealing furnace and, on the other hand, is uniformly sprayed on at least one or both surfaces of the steel strip by means of nozzles.

The hot strip preferably already has an initial nitrogen fraction No in the range of 0.001 wt % to 0.016 wt % in order to maximize the total nitrogen content in the cold-rolled steel sheet and in so doing maximizes the solid solution hardening caused by increasing the nitrogen content of the cold strip. The initial nitrogen content of the hot strip is preferably increased by at least 0.002 wt % on increasing the nitrogen content in the annealing furnace. The total nitrogen content, which consists of the sum of the initial nitrogen fraction No in the hot strip and the nitrogen fraction $\Delta N$ incorporated on increasing the nitrogen content of the cold-rolled steel strip in the annealing furnace, is adjusted during annealing of the cold-rolled steel strip by the presence of the nitrogen donor in the annealing furnace by diffusion of the atomic nitrogen of the nitrogen donor dissociated at the annealing temperatures into the cold-rolled steel sheet, thereby increasing the nitrogen fraction by $\Delta N$. The nitrogen fraction $\Delta N$ incorporated on increasing the nitrogen content in the annealing furnace then preferably lies at at least 0.002 wt %.

The total weight fraction of free nitrogen in a cold-rolled steel sheet is obtained from the sum of the free nitrogen content in the hot strip $N_{free}$ (hot strip) and the nitrogen $\Delta N$ added by increasing the nitrogen content in the continuous annealing furnace:

$$N_{free}=N_{free}(\text{hot strip})+\Delta N$$

It is then assumed that the nitrogen fraction $\Delta N$ on increasing the nitrogen content in the continuous annealing furnace is incorporated at least essentially in the interstitials. The upper limit for the weight fraction of free nitrogen in the cold-rolled steel sheet is then determined by the solubility limit of nitrogen in the ferrite lattice of the steel, which lies at about 0.1 wt %.

The nitrogen donor used for increasing the nitrogen content of the cold-rolled steel sheet in the annealing furnace can be a nitrogen-containing gas atmosphere in the annealing furnace, especially an ammonia-containing atmosphere, or a nitrogen-containing liquid that is applied to the surface of the cold-rolled steel sheet before it is heated in the annealing furnace. The nitrogen donor should then be formed so that atomic nitrogen is made available in the annealing furnace by dissociation, which can diffuse into the steel sheet. In particular, the nitrogen donor can be an ammonia gas. In order for this to dissociate to atomic nitrogen in the annealing furnace, furnace temperatures of more than 400° C. are preferably set in the annealing furnace on increasing the nitrogen content of the cold-rolled steel sheet.

Increasing the nitrogen content of the cold-rolled steel sheet in the continuous annealing furnace can then occur before, during, or after recrystallization annealing. For example, it is possible to increase the nitrogen content in the continuous annealing furnace in an upstream first zone of the continuous annealing furnace at a first temperature below the recrystallization temperature in the presence of a nitrogen donor and then to heat the steel sheet in a downstream second zone of the continuous annealing furnace for free recrystallization annealing at a second temperature above the recrystallization temperature. This sequence of increasing the nitrogen content and recrystallization annealing can also be reversed. Such decoupling of increasing the nitrogen content and recrystallization annealing in different zones of the continuous annealing furnace has the advantage that the optimal temperature can be set for the corresponding process, the optimal temperature for increasing the nitrogen content lying below that of recrystallization annealing. However, for economic reasons, a simultaneous increase in the nitrogen content and annealing of the steel sheet in the continuous annealing furnace is to be preferred at a temperature above the recrystallization temperature in the presence of a nitrogen donor.

By increasing the nitrogen content of the cold-rolled steel sheet in the annealing furnace, the situation can be achieved in which the nitrogen incorporated in essentially unbonded form, i.e., in dissolved form in the ferrite lattice of the steel, is introduced into the steel sheet, since nitrogen introduced on increasing the nitrogen content in the annealing furnace does not bind with strong nitride formers, like aluminum or chromium, to nitrides. A high strength is thus again achieved because the unbonded nitrogen dissolved in the steel contributes to an increase in strength because of solid solution hardening. A weight fraction of more than 0.003%, preferably at least 0.01% of the nitrogen is preferably incorporated in unbonded form interstitially in the steel. The nitrogen introduced into the cold-rolled steel sheet by increasing the nitrogen content in the annealing furnace can therefore contribute (almost) completely to solid solution hardening, and therefore to an increase in strength parameters of the packaging sheet metal product, so that a lower yield strength $Sb_{eL}$ of more than 300 MPa can be achieved in the hydraulic cupping test under a biaxial deformation (bulge test).

Since the solid solution hardening produced by increasing the nitrogen content of the steel sheet is most efficient if the incorporated nitrogen is introduced in unbonded form into the interstitials of the steel (especially the ferrite lattice), it is expedient if the alloy composition of the steel has as little (strong) nitride formers, like Al, Ti, B, Cr, Mo and/or Nb as possible in order to prevent the nitrogen from being bonded in the form of nitrides. The alloy composition of the steel therefore preferably has the following upper limits for the weight fraction of the following nitride-forming alloy components:

Al: <0.1%, preferably less than 0.05%;
Ti: <0.01%, preferably less than 0.002%;
B: <0.005%, preferably less than 0.001%;
Nb: <0.01%, preferably less than 0.002%;
Cr: <0.1%, preferably less than 0.08%;
Mo: <0.001%.

The total weight fraction of nitride formers is preferably less than 0.1%. A weight fraction of unbonded nitrogen of more than 0.003% in particular can thereby be ensured.

It has also been shown by comparison of packaging sheet metal products according to the invention with comparative samples not according to the invention that higher values for the strain-hardening exponent n can be achieved by increasing the nitrogen content of the cold-rolled steel sheet in the annealing furnace in the packaging sheet metal products according to the invention. The strain-hardening exponent n is a gauge of cold hardening of the packaging sheet metal product in the thickness direction. The packaging sheet metal products according to the invention are therefore characterized relative to comparative samples not according to the invention by an increased cold hardening in the plastic range between the Lüders elongation $Ab_e$ and the upper (plastic) elongation limit of $\varepsilon_{max}=0.5\cdot Ab\cdot(Sb_{eL}/Sb_m)$ due to the higher nitrogen fraction caused by increasing the nitrogen content in the annealing furnace.

The mechanical properties of the packaging sheet metal products according to the invention, which are ascertainable with the bulge test by determining a biaxial stress/strain curve, are then achieved after (artificial or natural) aging of the material. Natural aging can then be produced by longer storage of the material or by varnishing with subsequent drying of the varnish. However, an artificial aging by heat treatment of the packaging sheet metal products over a treatment time from 20 to 30 minutes at an aging temperature from 200 to 210° C. can also occur to characterize the material.

To produce packaging sheet metal products according to the invention, a slab is initially cast from a steel with the following composition, in terms of the weight fractions of the listed alloy components:

C: 0.001-0.06%,
Si: <0.03%, preferably 0.002 to 0.03%,
Mn: 0.17-0.5%,
P: <0.03%, preferably 0.005 to 0.03%,
S: 0.001-0.03%,
Al: 0.001-0.1%,
N: <0.016%, preferably 0.001 to 0.010%,
optionally Cr: <0.1%, preferably 0.01-0.08%,
optionally Ni: <0.1%, preferably 0.01-0.05%,
optionally Cu: <0.1%, preferably 0.002-0.05%,
optionally Ti: <0.01%,
optionally B: <0.005%,
optionally Nb: <0.01%,
optionally Mo: <0.02%,
optionally Sn: <0.03%,
remainder iron and unavoidable impurities.

The slab is hot rolled to a hot strip, in which the final rolling temperature during hot rolling of the slab is preferably above the Ar3 temperature of the steel and especially in the range of 800 to 920° C. The hot strip preferably has a thickness in the range of 2 mm to 4 mm. For economic and qualitative reasons, the highest possible hot strip thicknesses of preferably more than 2 mm are sought. However, to achieve final thicknesses of the cold-rolled steel sheet, higher hot strip thicknesses are necessary if the hot strip is to be cold rolled with ordinary roll stands without increasing the total cold reduction to values that are no longer technologically attainable. The thickness of the hot strip should therefore not exceed 4 mm. A range of 2 to 4 mm of hot strip thickness, on the one hand, prevents the formation of defects in the hot strip due to an unduly high reduction during hot rolling, as well as maintenance of the preferred final rolling temperature and, on the other hand, permits production of finished steel sheets by single or double cold rolling of the hot strip with ordinary roll stands with a high total cold reduction in the range of 80 to 98%.

The hot strip is then preferably wound at a winding temperature below the Ar1 temperature and especially in the range of 500 to 750° C. to a roll (coil). The wound coil of the hot strip is then preferably cooled by natural cooling to room temperature and expediently freed of scale by pickling. (Primary) cold rolling of the hot strip then occurs with a reduction ratio (cold reduction) of at least 80% to a cold-rolled steel strip. The cold-rolled steel strip is then introduced into an annealing furnace. The annealing furnace is preferably a continuous annealing furnace through which the cold-rolled steel strip is passed with a stipulated strip speed of preferably more than 200 m/min. Recrystallization annealing, on the one hand, occurs in the annealing furnace and an increase in nitrogen content, on the other hand, in which increasing the nitrogen content and recrystallization annealing can occur both simultaneously and in the same sections of the annealing furnace or also in succession and especially in different sections of the continuous annealing furnace. Recrystallization annealing then occurs at an annealing temperature of the steel strip of at least 630° C. Increasing the nitrogen content of the steel strip occurs in the annealing furnace in the presence of a nitrogen donor, which introduces a nitrogenizing gas atmosphere to the annealing furnace. The nitrogen donor, which is a nitrogenizing gas and especially ammonia gas, is preferably initially sprayed by means of nozzles onto at least one surface and preferably onto both surfaces of the steel strip in order to achieve uniform distribution of the introduced nitrogen over the thickness of the steel strip.

The dwell time of the steel strip in the annealing furnace preferably lies between 10 seconds and 400 seconds and can be set during use of a continuous annealing furnace by the strip speed with which the steel strip is passed through the continuous annealing furnace. This annealing time is sufficient in order to achieve complete recrystallization of the steel sheet, on the one hand, and the most homogeneous possible distribution of the nitrogen introduced to the steel strip over its thickness on increasing the nitrogen content in the annealing furnace, on the other hand.

A temperature at which a nitrogen donor introduced to the annealing furnace, which is preferably ammonia gas, at least partially dissociates to atomic nitrogen is set in the annealing furnace or in the region of the annealing furnace in which an increase in nitrogen content of the steel strip occurs to maintain a nitrogenizing gas atmosphere. This ensures the fullest possible, most rapid and most uniform diffusion of the nitrogen in atomic form to the interstitials of the steel lattice and thereby leads to homogeneous distribution of unbonded nitrogen in the steel strip and high solid solution hardening.

Following the increase in nitrogen content and recrystallization annealing, the steel strip is cooled to room temperature. Cooling can then occur passively by heat release or actively by means of a cooling fluid, for example, a cooling gas or water. Following cooling of the steel strip to room temperature, cold finishing or rerolling of the steel strip occurs with a final reduction of 0.2% to 45%. The final reduction is preferably less than 20% and especially lies in the range of 1 to 18%.

The total cold reduction [GKWG (total degree of cold rolling)]=1−d/D resulting after finishing or rerolling from thickness d of the packaging sheet metal product and thickness D of the hot strip preferably is at least 80%, especially at least 85% or more. With particular preference, the total cold reduction reaches the total cold reduction optimum dependent upon the composition of the steel, and expediently lies within a tolerance of 55% of the total cold reduction optimum. The total cold reduction optimum correlates with the geometric formation of ears that form on a sheet sample in a cupping test and is then characterized by a minimum in ear height and a number of six ears. The preferred final thicknesses of the packaging sheet metal products according to the invention then lie in the range of 0.10 mm to 0.50 mm, and especially in the thickness range of 0.12 mm to 0.35 mm.

Due to the increase in strength produced by solid solution hardening by increasing the nitrogen content of the steel sheet during annealing in the (continuous) annealing furnace in the presence of the nitrogen donor, finishing with a high final reduction is not required in the packaging sheet metal products according to the invention in order to further increase the strength by cold hardening. The final reduction can therefore preferably be restricted to a maximum of 20%, and preferably in the range of 1 to 18%, so that a deterioration of the isotropy of the material properties through a second cold rolling with high final reduction can be avoided.

After the second cold rolling or cold finishing, a varnish can be applied to the surface of the flat steel product to improve corrosion resistance, for example, by electrolytic deposition of a tin or chromium/chromium oxide coating and/or by varnishing with a varnish or by lamination of a polymer film from a thermoplastic, especially a film from a polyester, such as PET, or a polyolefin, such as PP or PE.

Despite the low carbon content, the packaging sheet metal products according to the invention are characterized by high base strength, which is achieved in particular by solid solution hardening due to the introduction of unbonded nitrogen on increasing the nitrogen content of the steel sheet in the annealing furnace. The packaging sheet metal products according to the invention have higher cold hardening during multiaxial plastic deformation in the production of packaging, which is especially advantageous in highly demanding deformations (for example, the ironing method, referred to as the DWI method) in order to be able to guarantee sufficient component safety. The strength of the packaging sheet metal products according to the invention can be additionally increased by natural or artificial aging of the steel sheet or the final product (packaging) produced from it.

The advantageous material properties and additional features of the packaging sheet metal products according to the invention as well as the production method and characterization of the packaging sheet metal products according to the invention by hydraulic cupping tests (bulge tests) are apparent from the examples described below with reference to the corresponding tables and drawings. The depicted examples serve merely to explain the invention and present the advantageous material properties of the packaging sheet metal products according to the invention relative to comparative examples not according to the invention and do not restrict the scope of protection of the invention, which is determined by the subsequently defined patent claims.

BRIEF DESCRIPTION OF THE DRAWINGS

The drawings show:

FIGS. 8-12: Show Table 1, Table 2A, Table 2B, Table 3A, and Table 3B. Note that all Tables presented herein follow the European numerical convention of using a comma as a decimal marker.

DETAILED DESCRIPTION

Figure 1:
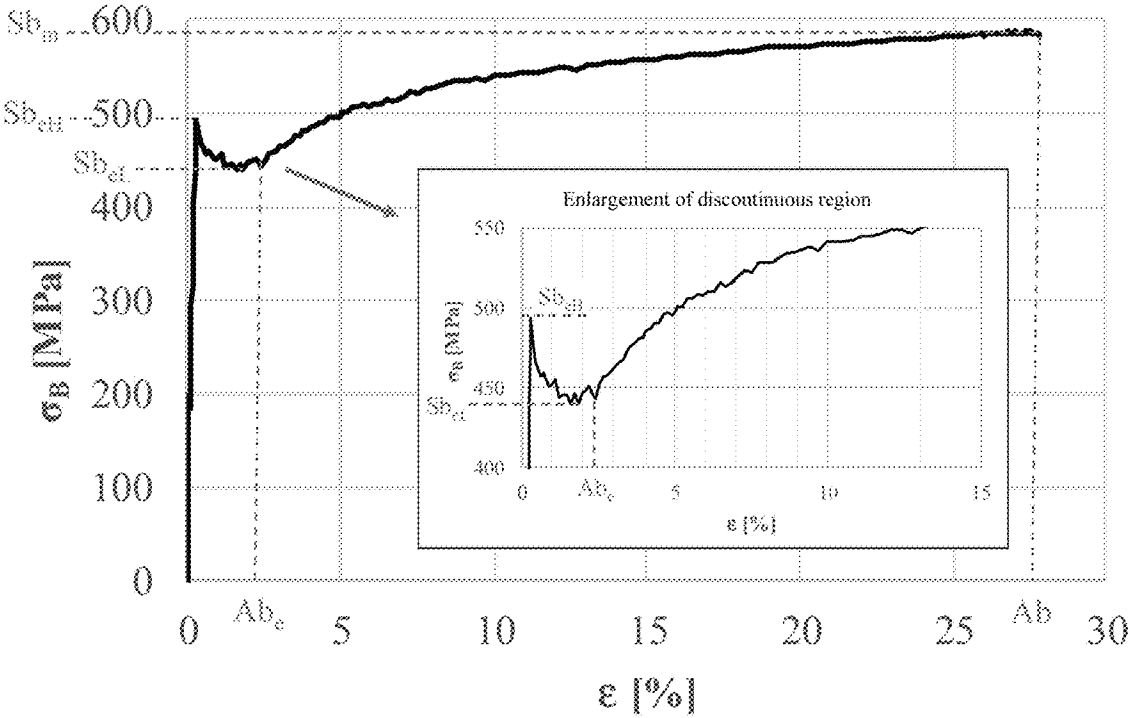
FIG. 1: Example for a biaxial stress/strain curve $\sigma_B(\varepsilon)$ determined from a bulge test of an aged steel sheet sample in which the recorded mechanical properties according to Table 1 are entered and the region of elastic-plastic deformation is shown enlarged in the insert.
Figure 2:
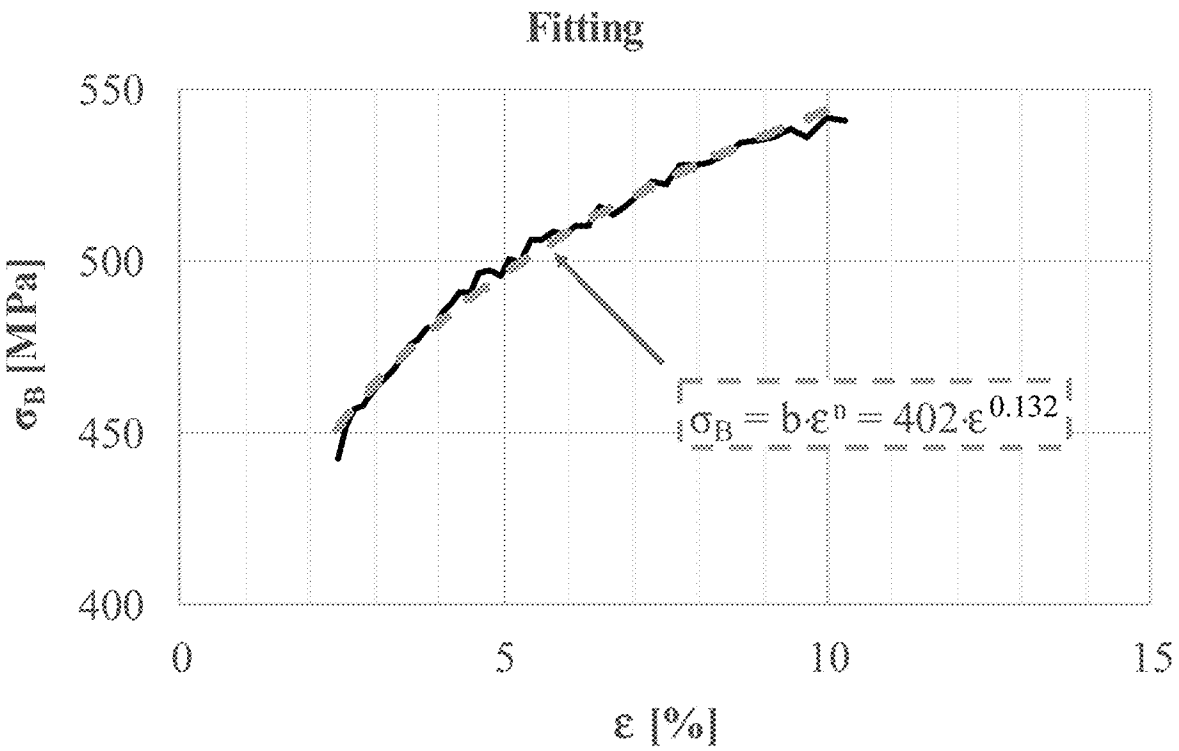
FIG. 2: Detailed view of the plastic region of the biaxial stress/strain curve of FIG. 1 above the Lüders elongation ($Ab_e$) with a corresponding fit of the function $\sigma_B=b\cdot\varepsilon^n$.

A slab is cast from a steel melt and hot-rolled to a hot strip for production of packaging sheet metal products according to the invention. The components of the steel from which the packaging sheet metal products according to the invention can be produced are explained in detail below, the data in percent referring to the weight fractions of the steel components.

Composition of the Steel:

Carbon, C: at least 0.001% and at most 0.06%:

Carbon has hardness and strength-increasing effect. The steel therefore contains at least 0.001 wt % carbon. Steels with low carbon content exhibit higher total cold reduction optimum, for which reason thinner steel sheets with equivalent earing tendency can be produced from hot strips with low carbon content and ordinary hot strip thicknesses in the range of 2 to 4 mm by cold rolling. In order to ensure rollability of the steel sheet during primary cold rolling and optionally in a second cold rolling step (rerolling or cold finishing) and at the same time low earing tendency and not reduce elongation at break, the carbon content should therefore be no higher than 0.06%. A lower carbon content also prevents pronounced anisotropy during production and processing of the steel sheets in the form of banding, since the carbon is largely present in the form of cementite due to the low solubility in the ferrite lattice of the steel. Moreover, the surface quality deteriorates with increasing carbon content and the risk of slab cracks increases with approach to the peritectic point.

Manganese, Mn: at least 0.17% and at most 0.5%:

Manganese also has a hardness- and strength-increasing effect. Manganese also improves the weldability and wear resistance of steel. The tendency toward red shortness is also reduced during hot rolling by the addition of manganese, since sulfur is bonded to the less hazardous MnS. Manganese also leads to grain refining and the solubility of nitrogen in the iron lattice is increased by manganese and diffusion of carbon to the surface of the slab can be prevented. A manganese content of at least 0.17 wt % is therefore preferred. To achieve higher strength, a manganese content of more than 0.2 wt %, especially 0.30 wt % or more is preferred. If the manganese content, however, becomes too high, this will be at the expense of the corrosion resistance of the steel and food compatibility is no longer guaranteed. The strength of the hot strip also becomes too high at unduly high manganese contents, which means that the hot strip can no longer be economically cold-rolled. The upper limit for manganese content is therefore 0.5 wt %.

Phosphorus, P: less than 0.03%

Phosphorus is an undesired accompanying element in steels. A high phosphorus content leads especially to embrittlement of the steel, and therefore causes a deterioration in deformation capability of steel sheets, for which reason the upper limit for phosphorus content lies at 0.03 wt %.

Sulfur, S: more than 0.001% and at most 0.03%

Sulfur is an undesired accompanying element that causes a deterioration in stretchability and corrosion resistance. No more than 0.03 wt % sulfur should therefore be contained in the steel. On the other hand, demanding and cost-intensive measures must be employed for desulfurization, for which reason a sulfur content of less than 0.001 wt % is no longer tolerable from an economic standpoint. The sulfur content therefore lies in the range of 0.001 wt % to 0.03 wt %, especially between 0.005 wt % and 0.01 wt %.

Aluminum, Al: more than 0.001% and less than 0.1%

Aluminum is required during steelmaking as a deoxidizer for killing. Aluminum also increases the scale resistance and deformation capability. The aluminum content therefore lies at more than 0.001 wt %. However, with nitrogen, aluminum forms aluminum nitrides, which are a disadvantage in the steel sheets according to the invention, since they reduce the fraction of free nitrogen. Unduly high aluminum concentrations can also lead to surface defects in the form of aluminum clusters. Aluminum is therefore used in a maximum concentration of 0.1 wt %.

Silicon, Si: less than 0.03%:

Silicon increases the scale resistance in steel and is a solid solution hardener. In steelmaking, silicon serves as deoxidizer. A further positive effect of silicon on steel is that it increases the tensile strength and yield strength. A silicon content of 0.002 wt % or more is therefore preferred. If the silicon content, however, becomes too high and especially exceeds 0.03 wt %, the corrosion resistance of the steel can deteriorate and surface treatments, especially by electrolytic coatings, can be hindered.

Optionally nitrogen, No: less than 0.007% and preferably more than 0.001%

Nitrogen is an optional component in the steel melt from which the steel is produced for the steel sheets according to the invention. Nitrogen does have a hardness- and strength-increasing effect as a solid solution hardener. However, an unduly high nitrogen content in the steel melt means that the hot strip produced from the steel melt can only be cold rolled with more difficulty. A high nitrogen content in the steel melt also increases the risk of defects in the hot strip, since the hot deformability becomes lower at nitrogen concentrations of 0.007 wt % or more. In the production of packaging sheet metal products according to the invention, it is proposed to increase the nitrogen content of the steel sheet subsequently by increasing the nitrogen content of the cold-rolled steel sheet in an annealing furnace. For this reason, the introduction of nitrogen into the steel melt can also be fully dispensed with. To achieve high solid solution hardening, however, it is preferable that an initial nitrogen content of more than 0.001 wt % be already contained in the steel melt.

To introduce an initial nitrogen content $N_0$ in the steel sheet before increasing the nitrogen content in the annealing furnace, nitrogen in an appropriate amount can be added to the steel melt, for example, by blowing in nitrogen gas and/or by the addition of a solid nitrogen compound, such as calcium cyanamide or manganese nitride.

Optionally: nitride formers, especially niobium, titanium, boron, molybdenum, chromium:

Nitride-forming elements, such as aluminum, titanium, niobium, boron, molybdenum and chromium are a disadvantage in steel of the steel sheets according to the invention because they reduce the fraction of free nitrogen by nitride formation. These elements are also expensive and therefore increase production costs. On the other hand, the elements niobium, titanium and boron have a strength-increasing effect by grain refinement as microalloy components without reducing toughness. The mentioned nitride formers can therefore be advantageously added within certain limits as alloy components of the steel melt. The steel can therefore (optionally) contain the following nitride-forming alloy components, in terms of weight:

Titanium, Ti: preferably more than 0.0005% but less than 0.01% for cost reasons, Boron, B: preferably more than 0.0005% but less than 0.005% for cost reasons, and/or Niobium, Nb: preferably more than 0.001%, but less than 0.01% for cost reasons and/or Chromium, Cr: preferably more than 0.01% in order to permit the use of scrap in the production of the steel melt and to hinder diffusion of carbon to the surface of the slab, but to avoid carbides and nitrides, at most 0.1% and/or Molybdenum Mo: less than 0.02% in order to avoid unduly severe increase in the recrystallization temperature;

To avoid a reduction in the fraction of free unbonded nitrogen $N_{free}$ by nitride formation, the total weight fraction of the mentioned nitride former in the steel melt is preferably less than 0.1%.

Further Optional Components:

In addition to the residual iron (Fe) and unavoidable impurities, the steel melt can contain further optional components, such as optionally copper, Cu: more than 0.002% in order to permit the use of scrap in production of the steel melt, but less than 0.1% in order to guarantee food compatibility;

optionally nickel, Ni: more than 0.01% in order to permit the use of scrap in the production of the steel melt and to improve toughness, but less than 0.1% in order to guarantee food compatibility;

optionally tin, Sn: preferably less than 0.03%;

Production Method:

A steel melt that is extruded and divided into slabs after cooling is initially produced with the described composition of the steel to make the packaging sheet metal products according to the invention. The slabs are then again heated to preheating temperatures of more than 1100° C., especially 1200° C. and hot rolled to produce a hot strip with a thickness in the range of 2 to 4 mm.

The final rolling temperature during hot rolling preferably lies above the Ar3 temperature in order to remain austenitic and lies especially between 800 and 920° C.

The hot strip is wound to a coil at a stipulated and expediently constant winding temperature (coiling temperature, HT). The winding temperature then preferably lies below Ar1 in order to remain in the ferritic region, preferably in the range of 500 to 750° C. and especially less than 640° C. in order to avoid precipitation of AlN. For economic reasons, the winding temperature should lie at more than 500° C. After winding, the coil of the hot strip is cooled by natural cooling. Formation of iron nitrides on the surface of the hot strip can be avoided by active cooling of the hot strip after completion of hot rolling up to winding at higher cooling rates.

To produce a packaging steel in the form of a thin steel sheet in the thickness range of less than 0.6 mm (fine sheet thicknesses) and preferably with a final thickness of less than 0.35 mm, the hot strip is initially pickled and then cold rolled, wherein a thickness reduction (cold reduction) of at least 80% and preferably in the range of 85 to 98% expediently occurs. To restore the crystal structure destroyed during cold rolling of the steel, the cold rolled steel strip is then recrystallization annealed in an annealing furnace. This occurs, for example, by passing the steel sheet present in the form of cold-rolled steel strip through a continuous annealing furnace at a strip speed of at least 200 m/min, in which the steel strip is heated to temperatures above the recrystallization temperature of the steel. An increase in the nitrogen content of the cold-rolled steel sheet then occurs before or preferably simultaneously with recrystallization annealing by heating the steel sheet in the annealing furnace in the presence of a nitrogen donor. Increasing the nitrogen content is then preferably conducted simultaneously with recrystallization annealing by introducing a nitrogen donor into the annealing furnace, especially in the form of nitrogen-containing gas and heating the steel sheet to an annealing temperature above the recrystallization temperature of the steel and holding it for an annealing time (holding time) of preferably 10 to 150 seconds at the annealing temperature. The annealing temperature then preferably lies above 630° C. and especially in the range of 640 to 750° C. The nitrogen donor is chosen so that atomic nitrogen is formed at the temperatures in the annealing furnace by dissociation of the nitrogen donor, which can diffuse into the steel sheet. Ammonia has been shown to be a suitable nitrogen donor for this purpose. In order to avoid oxidation of the surface of the steel sheet during annealing, a protective gas atmosphere is expediently used in the annealing furnace. The atmosphere in the annealing furnace preferably consists of a mixture of the nitrogen-containing gas acting as nitrogen donor and a protective gas, such as forming gas or nitrogen gas ($N_2$ gas), wherein the volume fraction of protective gas during feed is preferably between 95% and 99.98% and the remaining volume fraction of the supplied gas is formed by the nitrogen-containing gas, especially ammonia gas ($NH_3$ gas). An equilibrium concentration from 0.02 to 2 vol % ammonia is preferably maintained during an increase in the nitrogen content in the annealing furnace, and ammonia gas is simultaneously sprayed onto the surfaces of the steel sheet by means of nozzles. The formation of a hard and brittle nitride layer on the surface of the steel sheet is thereby prevented, and this ensures that the nitrogen diffuses in high concentration into the interior of the steel sheet and is interstitially incorporated there uniformly in the (ferrite) lattice of the steel. An increase in the initial nitrogen concentration No by $\Delta N \geq 0.002$ wt % preferably occurs by increasing the nitrogen content. The weight fraction of total nitrogen in the recrystallized and nitrogenized steel sheet produced by increasing the nitrogen content in the annealing furnace preferably lies between 0.002 and 0.12%, especially between 0.004 and 0.07%.

EMBODIMENT EXAMPLES

Embodiment examples of the invention and comparative examples are explained below. The steel sheets of the embodiment examples of the invention and the comparative examples were produced from steel melts with the alloy compositions listed in Tables 2A and 2B (FIGS. 9 and 10) by hot rolling and subsequent cold rolling. The cold-rolled steel sheets were then recrystallization annealed in a continuous annealing furnace, in which steel sheets were held during a stipulated annealing time in the range of 10 to 120 seconds at annealing temperatures of 630° C. or more.

The steel sheets according to the invention, which are marked "according to the invention" in Tables 2A and 2B, were nitrogenized before or during the recrystallization annealing in the annealing furnace by setting an ammonia atmosphere with an equilibrium concentration of ammonia of 0.02% to preferably 2 vol % in the annealing furnace and simultaneously directing ammonia gas onto the surfaces of the steel sheets by means of nozzles. The nitrogen content was brought from an initial nitrogen content $N_0$ of the hot strip in the steel sheets according to the invention to a higher nitrogen content N. Both the initial nitrogen content $N_0$ and also the nitrogen content $N=N_0+\Delta N$ achieved after increasing the nitrogen content in the annealing furnace are shown in Tables 2A and 2B in the steel sheets according to the invention, $\Delta N$ being the nitrogen content introduced to the steel sheet on increasing the nitrogen content in the annealing furnace.

During recrystallization annealing of the steel sheets not according to the invention, which are marked in Tables 2A and 2B "not according to the invention," an inert gas atmosphere without nitrogen donor (i.e., without nitrogenizing components) was present in the annealing furnace so that the steel sheets not according to the invention were not nitrogen-treated in the annealing furnace and the weight fraction of nitrogen is the same before and after heat treatment in the annealing furnace (i.e., $N=N_0$).

After heat treatment in the annealing furnace, both the steel sheets according to the invention and the steel sheets of the embodiment examples not according to the invention (not nitrogenized in the annealing furnace), which are marked in Tables 2A and 2B "not according to the invention," were rerolled or finished in a second cold-rolling step.

Subsequently, i.e., after the second cold rolling (rerolling or finishing), artificial aging of the steel sheets was achieved by heating the sample for 20 minutes to 200° C. The mechanical properties of the samples of the steel sheets according to the invention and the practical examples not according to the invention artificially aged in this way are shown in Tables 3A and 3B (FIGS. 11 and 12), in which Thickness is the final thickness of the rerolled steel sheets (in mm), NWG is the final reduction during secondary cold rolling (in %), $Sb_{eH}$ is the upper yield strength (in MPa), $Sb_{eL}$ is the lower yield strength (in MPa), $Sb_m$ is the absolute strength (in MPa), Ab is the elongation at break (in %), $Ab_e$ is the Lüders elongation (in %), b is a proportionality factor in MPa and n is a strain-hardening exponent, which is obtained from a description of the biaxial stress/strain curve determined in the bulge test $\sigma_B(\varepsilon)$ in the plastic region above the Lüders elongation ($Ab_e$) by the function $\sigma_B=b\cdot\varepsilon^n$, where $\sigma_B$ is the (true) biaxial stress in MPa determined in the bulge test and $\varepsilon$ is the amount of the true elongation (in %) in the thickness direction (the true elongation in the thickness direction is negative due to the thickness reduction in the biaxial tensile test of the bulge test; elongation $\varepsilon$ is therefore always understood to mean the amount of negative elongation in the thickness direction of the sheet).

The mechanical characteristics of the samples, such as the upper yield strength ($Sb_{eH}$ in MPa), the lower yield strength ($Sb_{eL}$ in MPa), the absolute strength ($Sb_m$ in MPa), the elongation at break (Ab in %) and the Lüders elongation ($Ab_e$ in %) were then determined from the biaxial stress/strain diagram as explained by means of the example of FIG. 1.

Figure 3A:
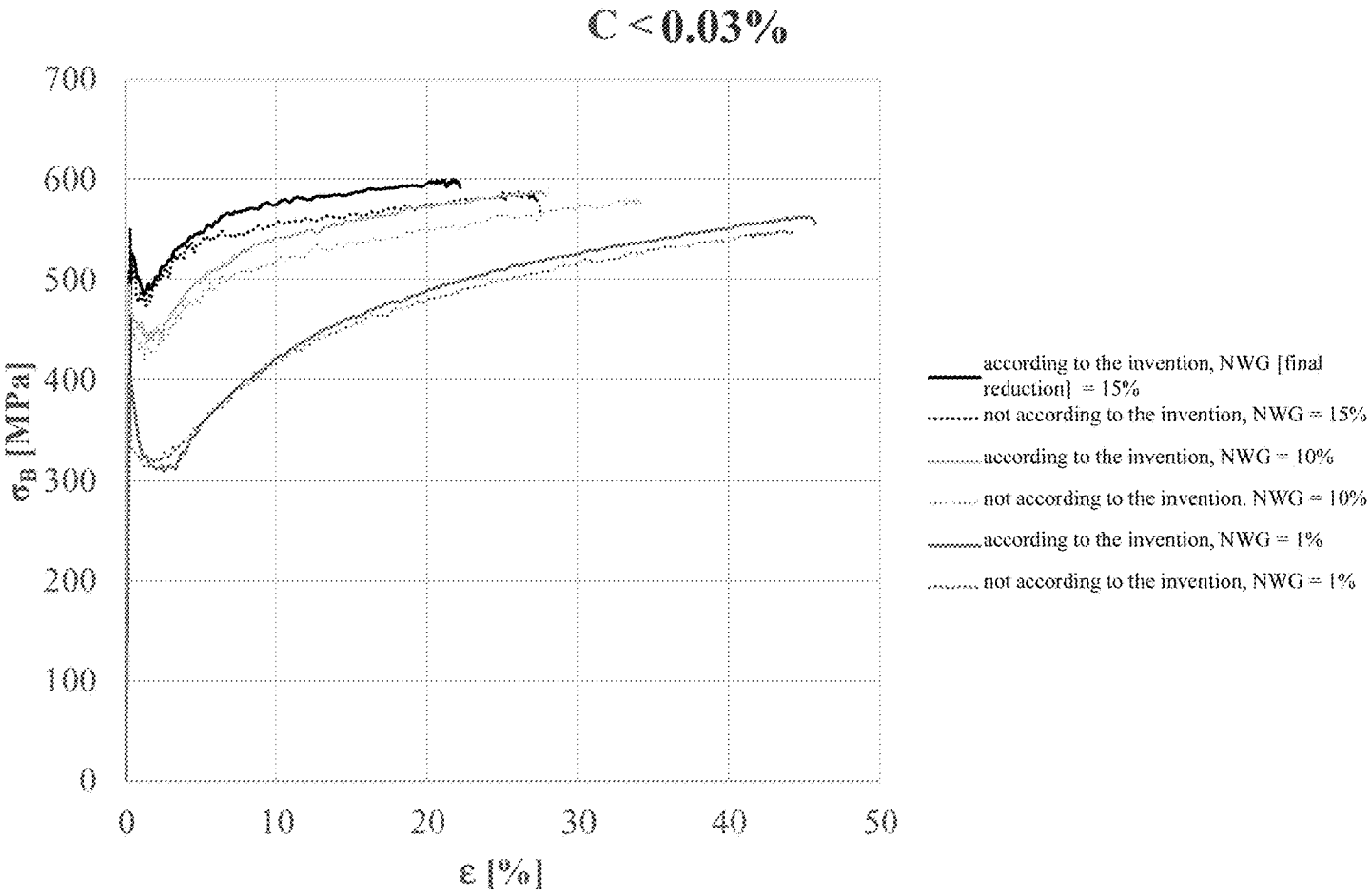
FIGS. 3A&3B Biaxial stress/strain curves determined from a bulge test of steel sheet samples according to the invention and not according to the invention, each with comparable composition of the hot strip and different nitrogen content and the same final reduction, FIG. 3A showing the stress/strain curve of steel sheet samples according to the invention and not according to the invention with low carbon content (C<0.03 wt %), and FIG. 3B showing the stress/strain curves of steel sheet samples according to the invention and not according to the invention with a higher carbon content (C>0.03 wt %)
Figure 3B:
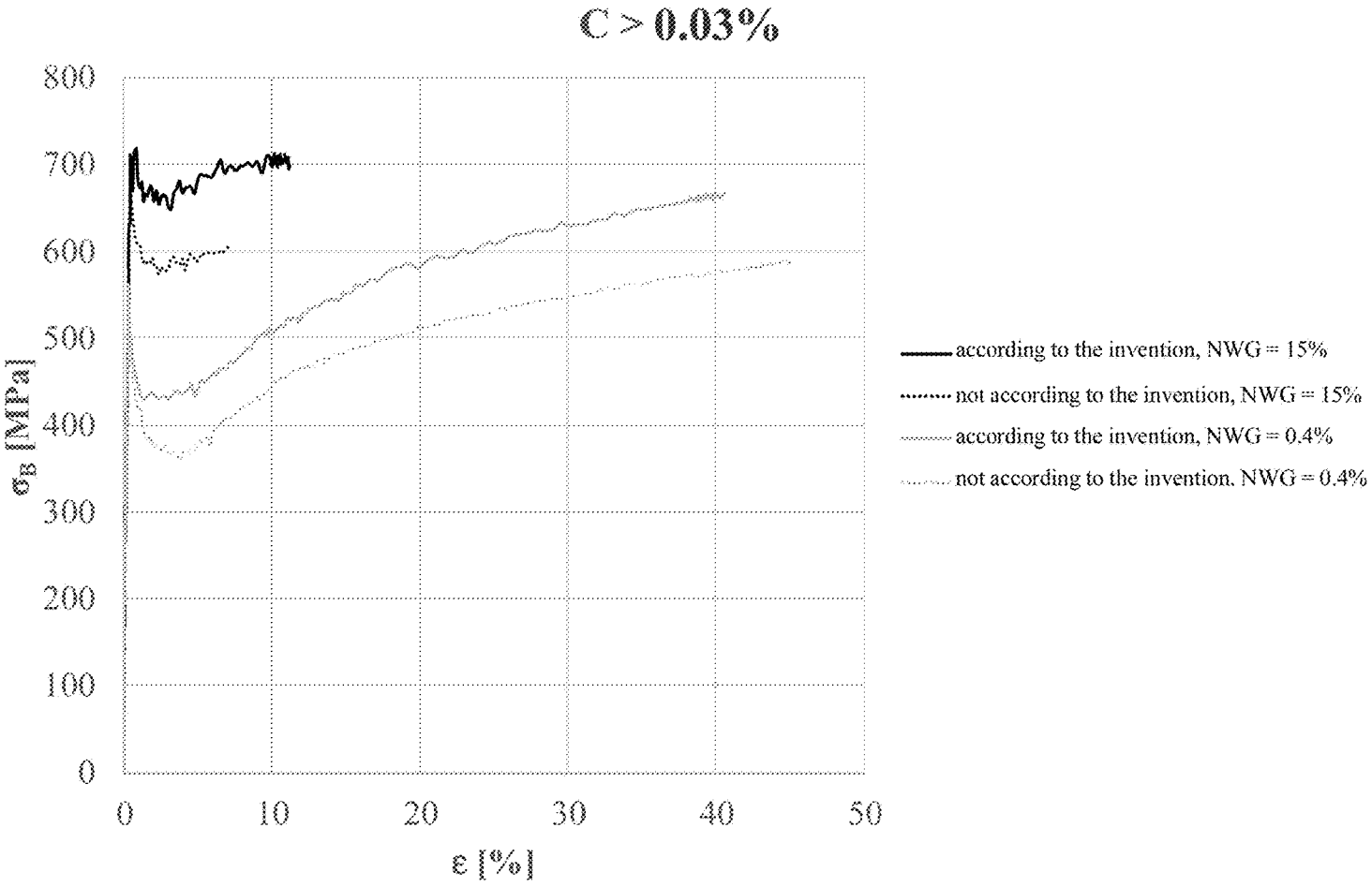

Biaxial stress/strain curves are shown in FIGS. 3A and 3B, which were determined from a bulge test on samples of steel sheets according to the invention and not according to the invention, FIG. 3A showing the samples with low carbon content (C<0.03%), and FIG. 3B showing samples with higher carbon content (C>0.03%). The samples according to the invention and not according to the invention are then contrasted with identical composition and the same final reduction (NWG). From comparison of the biaxial stress/strain curves of samples according to the invention and not according to the invention, it is apparent that the biaxial stress in the plastic region above the Lüders elongation ($\varepsilon>Ab_e$) is regularly greater in the samples according to the invention than in the samples not according to the invention. This indicates higher cold hardening of the samples according to the invention in the bulge test. The difference in cold hardening between the samples according to the invention and the samples not according to the invention is particularly high at higher carbon concentrations (C>0.03%) in the composition of the steel (see FIG. 3B).

A further gauge for hardening of a steel sheet sample is the (biaxial) lower yield strength $Sb_{eL}$ determined in the bulge test. This is dependent, inter alia, upon the final reduction (NWG). For graphic representation of hardening of samples according to the invention and not according to the invention lower yield strengths $Sb_{eL}$ determined from the bulge test are shown in FIGS. 4A and 4B as a function of the final reduction NWG (in %), where FIG. 4A again shows steel sheet samples with low carbon content (C<0.03%) and FIG. 4B shows samples with higher carbon content (C>0.03%).

Figure 4A:
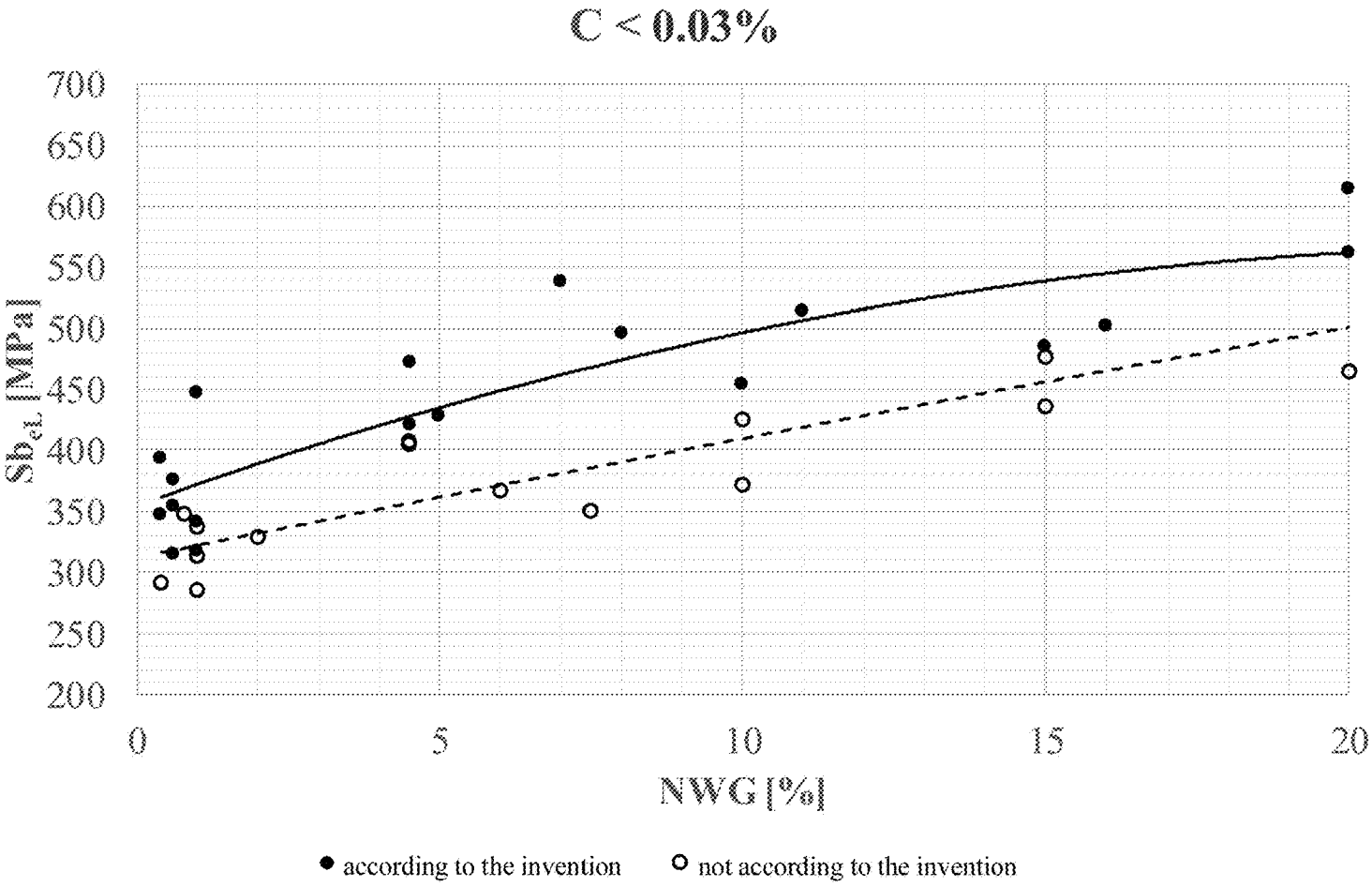
FIGS. 4A&4B Depiction of the trend of the lower yield strength ($Sb_{eL}$ in MPa) determined from the biaxial stress/strain curve of steel sheet samples according to the invention and not according to the invention as a function of final reduction (NWG [degree of rerolling] in %), FIG. 4A showing the values of the samples with low carbon content (C<0.03 wt %), and FIG. 4B showing the values of the samples with higher carbon content (C>0.03 wt %)
Figure 4B:
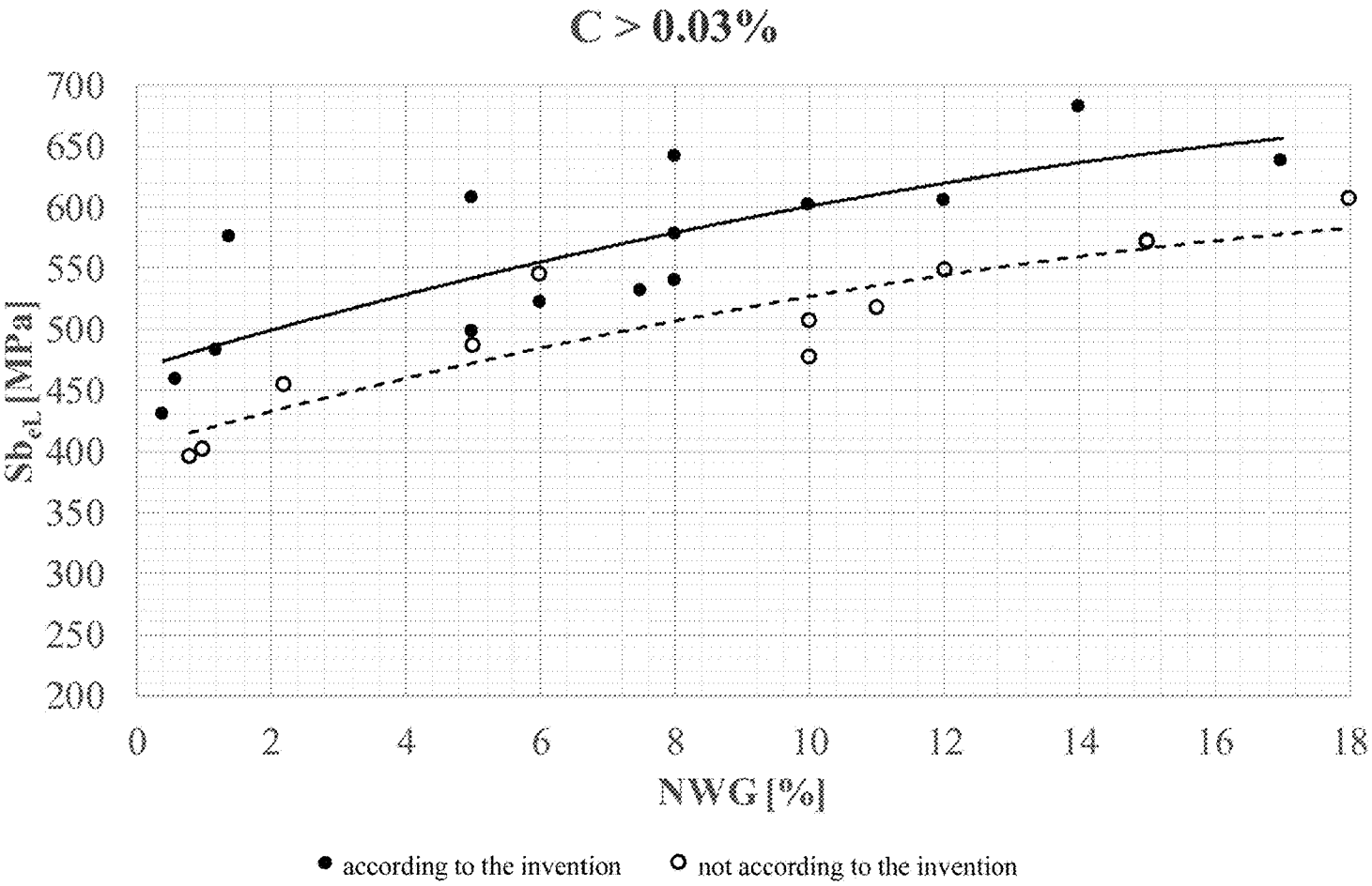

It is apparent from a comparison of the samples according to the invention and the samples not according to the invention from the depictions in FIGS. 4A and 4B that the samples according to the invention have a higher lower yield strength ($Sb_{eL}$) at the same final reduction (NWG) relative to the samples not according to the invention.

Figure 5A:
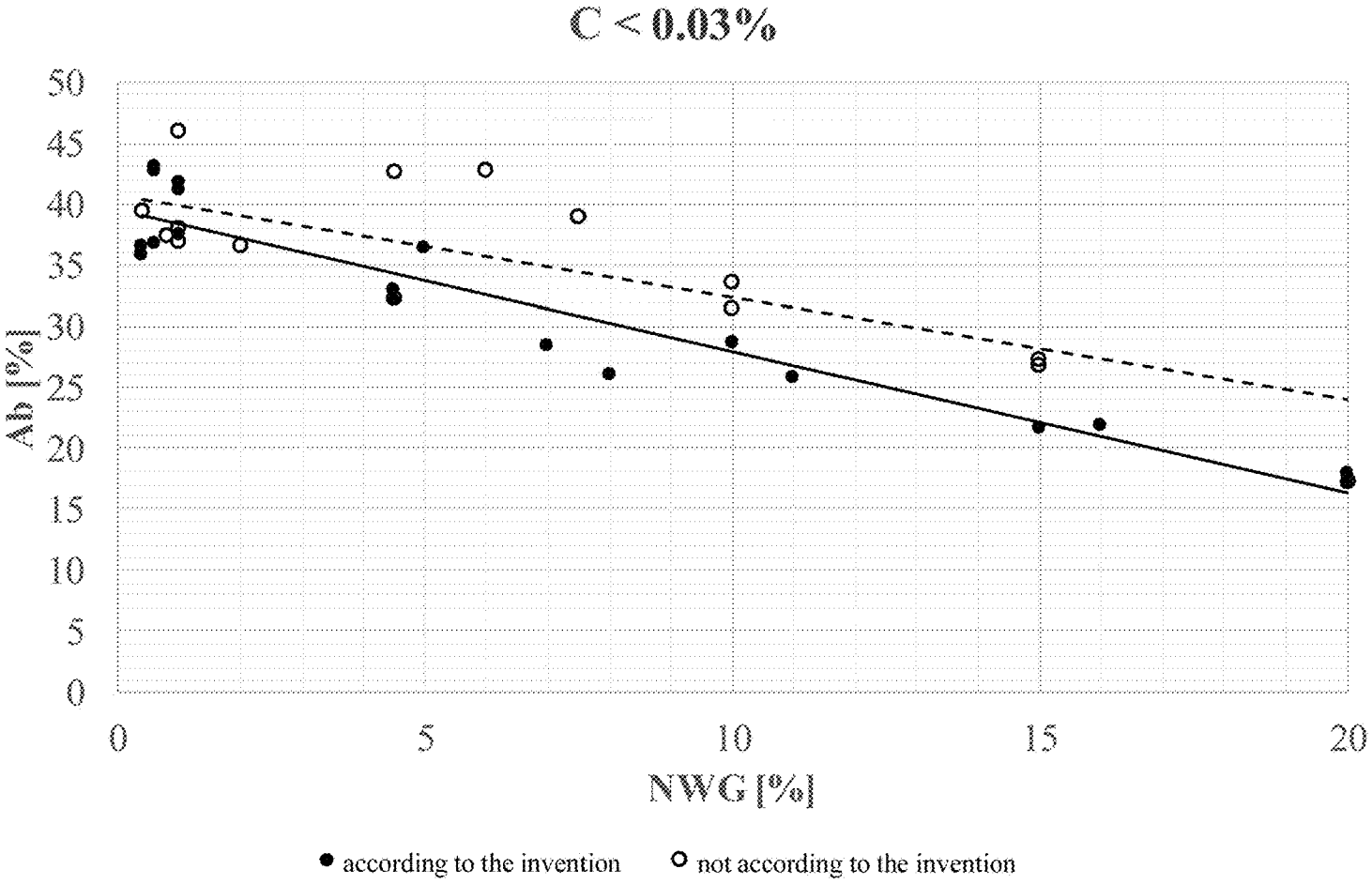
FIGS. 5A&5B Depiction of the trend of elongation at break (Ab in MPa) determined from the biaxial stress/strain curve of steel sheet samples according to the invention and not according to the invention as a function of final reduction (NWG in %), FIG. 5A showing the value of the samples with low carbon content (C<0.03 wt %), and FIG. 5B showing the value of the samples with higher carbon content (C>0.03 wt %)
Figure 5B:
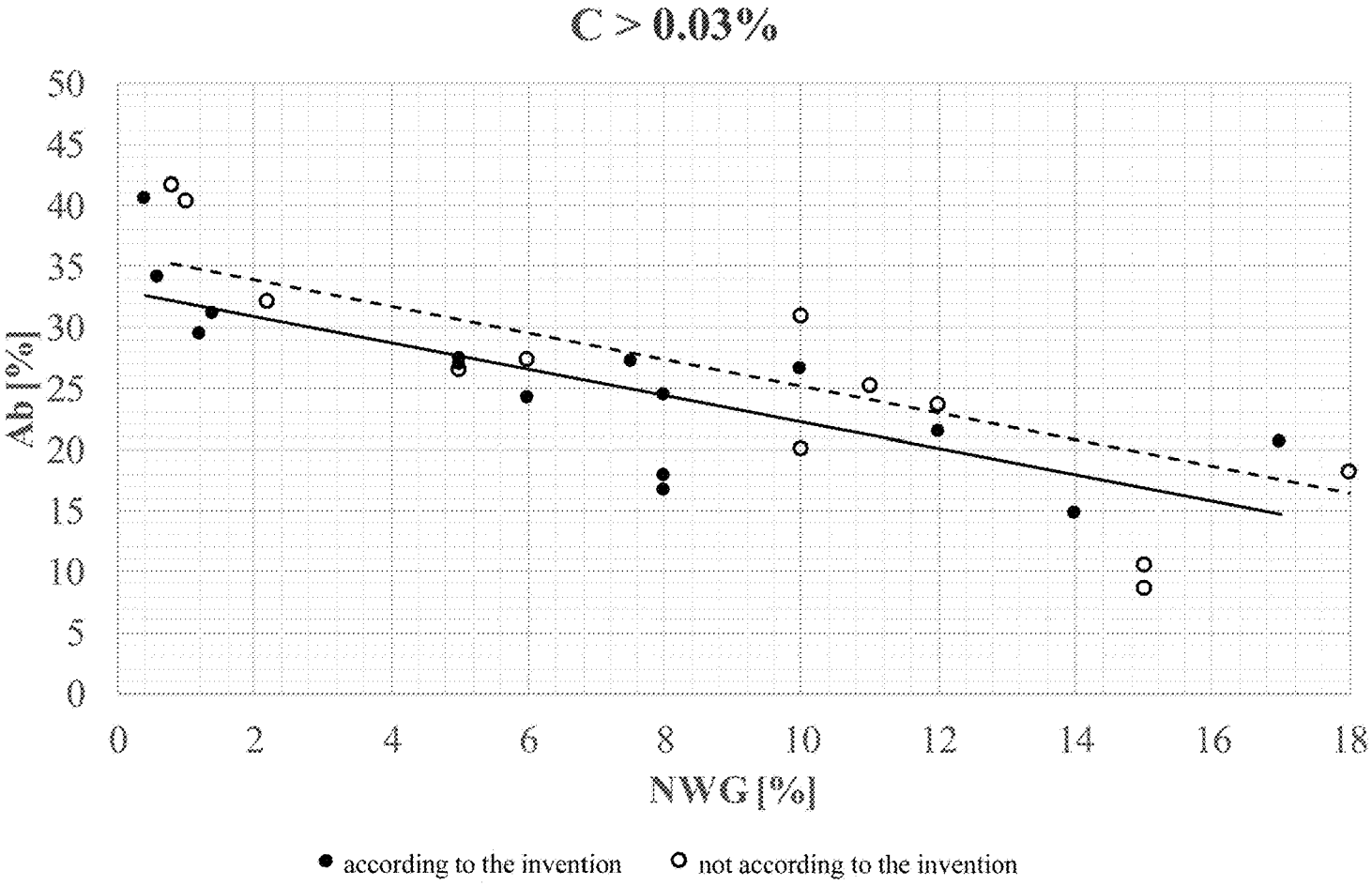

The trend of elongation at break (Ab in %) from the bulge test of samples according to the invention and samples not according to the invention is shown in FIGS. 5A and 5B as a function of final reduction (NWG in %), FIG. 5A showing samples with lower carbon content (C<0.03%) and FIG. 5B showing samples with higher carbon content (C>0.03%). It can be deduced from a comparison of the elongation at break of the samples according to the invention and the samples not according to the invention from FIGS. 5A and 5B that the elongation at break of the samples according to the invention is higher at the same final reduction (NWG).

Figure 6A:
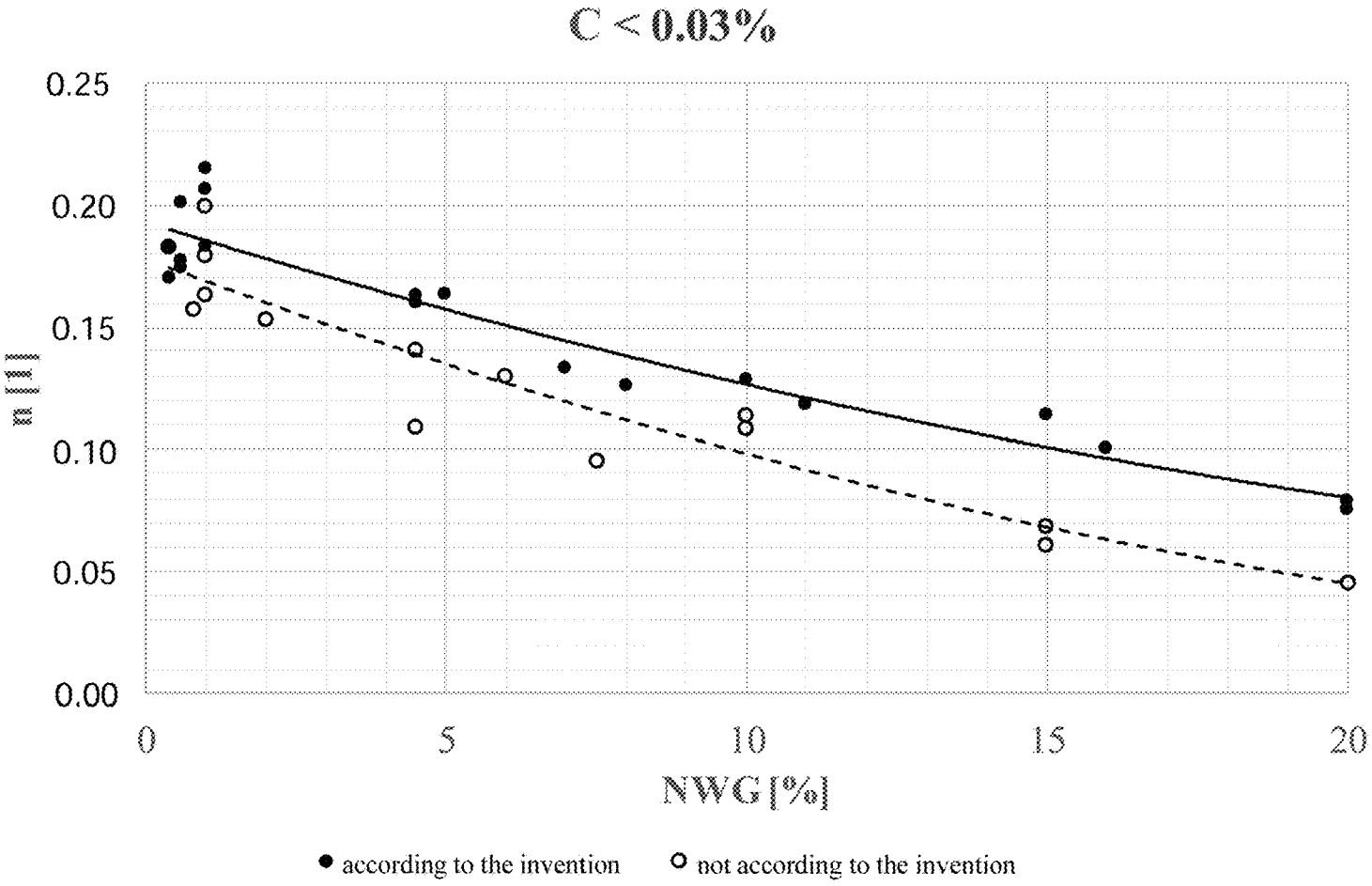
FIGS. 6A&6B Depiction of the trend of strain-hardening exponents n determined from the plastic region of the biaxial stress/strain curve $\sigma_B=b\cdot\varepsilon^n$ of steel sheet samples according to the invention and not according to the invention as a function of final reduction (NWG in %), FIG. 6A showing the values of the samples with low carbon content (C<0.03 wt %), and FIG. 6B showing the values of the samples with higher carbon content (C>0.03 wt %)
Figure 6B:
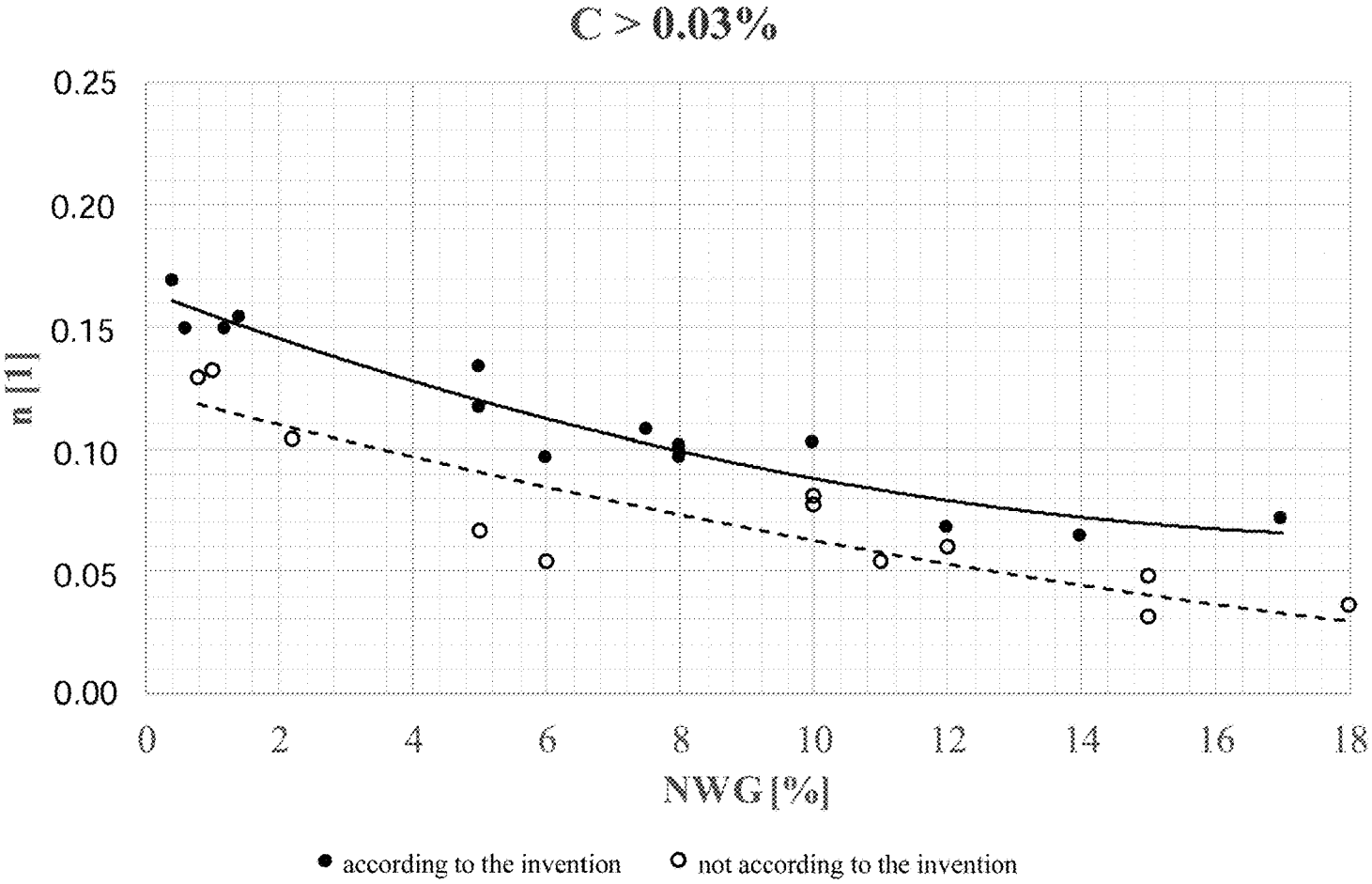

The proportionality factor b and the strain-hardening exponent n were determined by fit functions $\sigma_B=b\cdot\varepsilon^n$ from the biaxial stress/strain curves determined in the bulge test of the samples according to the invention and the samples not according to the invention in the plastic region between the Lüders elongation $Ab_e$ and an upper (plastic) yield strength of $\varepsilon_{max}=0.5\cdot Ab\cdot(Sb_{eL}/Sb_m)$, where Ab is the elongation at break, $Sb_{eL}$ is the lower yield strength, and $Sb_m$ is the absolute strength. The values determined for the investigated samples for the proportionality factor b and the strain-hardening exponent n are stated in Tables 3A and 3B. The strain-hardening exponent n then represents a gauge of cold hardening of a steel sheet sample in the bulge test. Since the strain-hardening exponent n is also dependent on the final reduction (NWG), the strain-hardening exponents n of samples according to the invention and samples not according to the invention determined from the bulge test are shown in FIGS. 6A and 6B as a function of the final reduction (NWG in %), FIG. 6A showing the samples with low carbon content (C<0.03%) and FIG. 6B showing samples with higher carbon content (C>0.03%). It can be deduced from a comparison of the samples according to the invention and the samples not according to the invention that the strain-hardening exponent n of the samples according to the invention is higher at the same final reduction (NWG) than in the samples not according to the invention.

Figure 7:
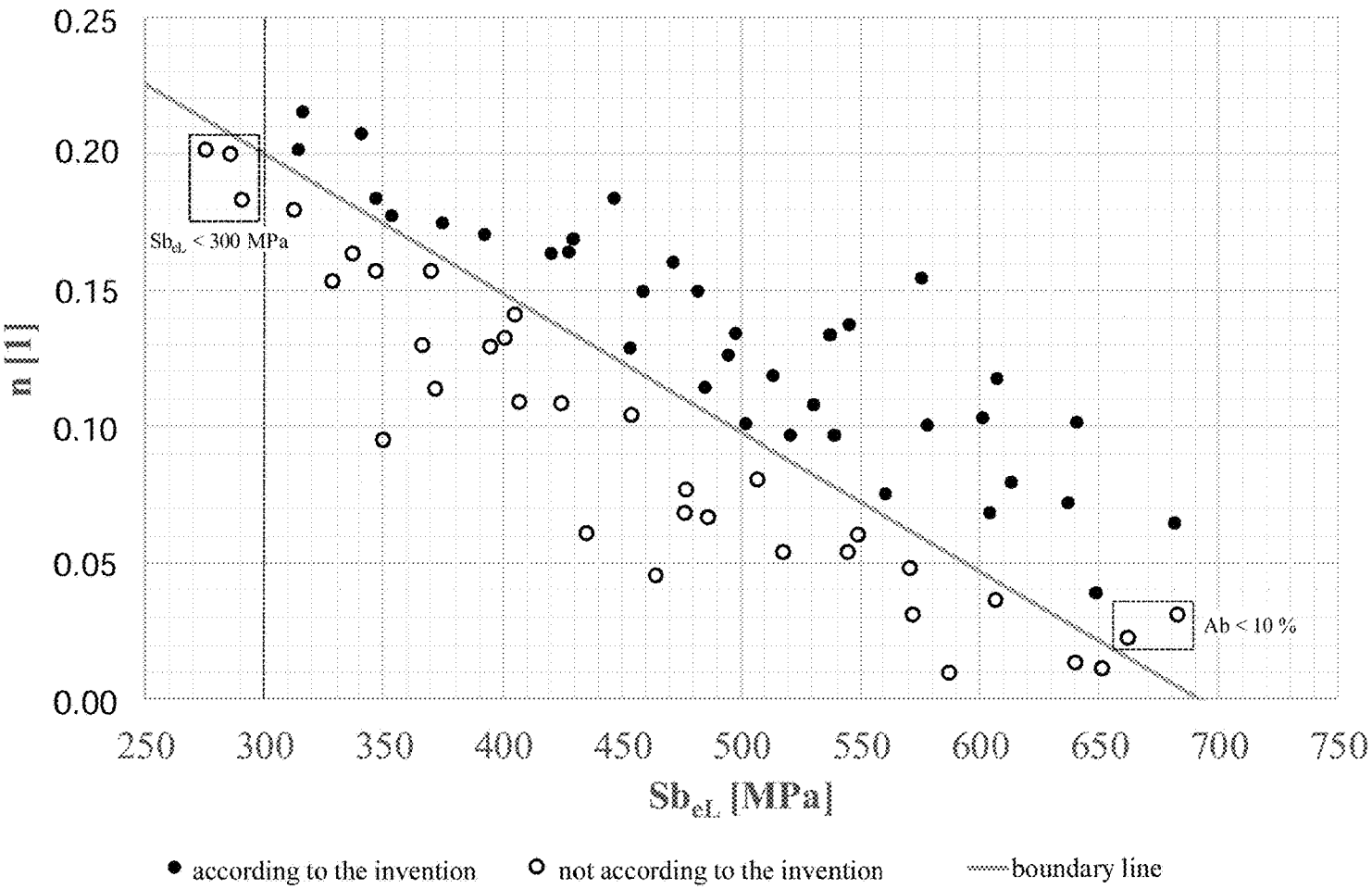
FIG. 7: Depiction of the trend of strain-hardening exponents determined from the elastic-plastic region of the biaxial stress/strain curve $\sigma_B=b\cdot\varepsilon^n$ of FIGS. 6A and 6B of steel sheet samples according to the invention and not according to the invention as a function of their lower yield strength ($Sb_{eL}$ in MPa) according to FIGS. 4A and 4B.

A quantification of cold hardening of steel sheet samples in the bulge test independent of final reduction can be achieved by representing the strain-hardening exponents n determined in the bulge test as a function of the lower yield strength $Sb_{eL}$. FIG. 7 therefore shows the strain-hardening exponents n determined in the bulge test as a function of lower yield strength $Sb_{eL}$. It can be deduced from FIG. 7 that the strain-hardening exponents n of the samples according to the invention at the same lower yield strength $Sb_{eL}$ are higher than in the samples not according to the invention. For lower yield strengths of $Sb_{eL}$>300 MPa and a lowest elongation at break of Ab>10% a delimitation of the sample according to the invention from the sample not according to the invention can be stated by the following trend of the strain-hardening exponents n as a function of lower yield strength $Sb_{eL}$ (in MPa):

$$n\geq 0.353-5.1\cdot Sb_{eL}/10^4 \text{ MPa.}$$

The samples according to the invention that satisfy the equation above are characterized in comparison with the samples not according to the invention by a higher yield strength and a higher cold hardening, and are therefore better suited for multiaxial deformations in comparison with the samples not according to the invention, as occur, for example, during production of three-dimensional can bodies from the packaging sheet metal products. The samples according to the invention are then characterized in particular by a higher cold hardening after aging (i.e., after natural or artificial aging of the sample). The higher cold hardening in the samples according to the invention can be achieved by incorporating unbonded nitrogen on increasing the nitrogen content of the samples in the annealing furnace and the resulting solid solution hardening.

What is claimed is:

1. A packaging sheet metal product comprising a cold-rolled steel sheet having a thickness (d) of less than 0.6 mm and containing components, in terms of weight:

C: 0.001-0.06%,
Si: <0.03%,
Mn: 0.17-0.5%,
P: <0.03%,
S: 0.001-0.03%,
Al: 0.001-0.1%, and
N: 0.002-0.12%, wherein the packaging sheet metal product, during biaxial deformation in a bulge test, which bulge test determines mechanical parameters of the packaging sheet metal product such as a true biaxial stress ($\sigma_B$), a true elongation ($\varepsilon$) in a thickness direction, an absolute strength ($Sb_m$), a lower yield strength ($Sb_{eL}$), an elongation at break (Ab), and a Lüders elongation ($Ab_e$), has a lower yield strength ($Sb_{eL}$) of more than 300 MPa, a corresponding elongation at break (Ab) of more than 10%, a plastic region between the Lüders elongation ($Ab_e$) and an upper plastic elongation limit of $\varepsilon_{max}=0.5\cdot Ab\cdot(Sb_{eL}/Sb_m)$, and a biaxial stress/strain diagram $\sigma_B(\varepsilon)$ represented by a function $\sigma_B=b\cdot\varepsilon^n$, wherein $\sigma_B$ is the true biaxial stress in MPa,
$\varepsilon$ is an amount of true elongation in the thickness direction in %,
$Sb_{eL}$ is the lower yield strength,
$Sb_m$ is the absolute strength,
$Ab_e$ is the Lüders elongation,
b is a proportionality factor, and
n is a strain-hardening exponent, and wherein a strengthening of the packaging sheet metal product in the thickness direction is characterized by a strain-hardening exponent of $$n\geq 0.353-5.1\cdot Sb_{eL}/10^4 \text{ MPa.}$$

2. The packaging sheet metal product according to claim 1, wherein a weight fraction of nitrogen of at least 0.002% is incorporated interstitially in steel of the packaging sheet metal product in unbonded form.

3. The packaging sheet metal product according to claim 1, further comprising at least one of, in terms of weight:

Cr: <0.1%
Ni: <0.1%,
Cu: <0.1%,
Ti: <0.01%,
B: <0.005%,
Nb: <0.01%,
Mo: <0.02%,
Sn: <0.03%, residual iron, and unavoidable impurities.

4. The packaging sheet metal product according to claim 1, wherein the packaging sheet metal product is obtained by:

hot rolling a steel slab to produce a hot strip having a thickness in a range of 2 mm to 4 mm,
winding the hot strip at a winding temperature below an Ar1 temperature,
cold rolling the hot strip at a reduction ratio of at least 80% to produce a cold-rolled steel strip,
increasing nitrogen content of the cold-rolled steel strip in an annealing furnace in a presence of a nitrogen donor at a temperature of at least 550° C. and recrystallization annealing the cold-rolled steel strip in the annealing furnace at an annealing temperature of at least 630° C.,
cooling the recrystallization-annealed steel strip to room temperature, and
rerolling the recrystallization-annealed steel strip at a final reduction of 0.2% to 45%.

5. The packaging sheet metal product according to claim 4, wherein a final rolling temperature during hot rolling of the steel slab is greater than an Ar3 temperature.

6. The packaging sheet metal product according to claim 4, wherein a dwell time of the cold-rolled steel strip in the annealing furnace is between 10 seconds and 400 seconds.

7. The packaging sheet metal product according to claim 4, wherein the final reduction is between 0.2% and 20%.

8. The packaging sheet metal product according to claim 4, wherein the nitrogen donor is at least partially dissociated to atomic nitrogen at temperatures in the annealing furnace.

9. The packaging sheet metal product according to claim 4, wherein the nitrogen donor is ammonia gas.

10. The packaging sheet metal product according to claim 4, wherein the hot strip has an initial weight fraction of nitrogen $N_0$ in a range of 0.001 wt % to 0.016 wt % and wherein the weight fraction of nitrogen in the cold-rolled steel strip is increased by $\Delta N \geq 0.002$ wt % in the presence of the nitrogen donor during annealing in the annealing furnace.

11. The packaging sheet metal product according to claim 1, wherein the cold-rolled steel strip contains a surface coating on at least one surface.

12. The packaging sheet metal product according to claim 11, wherein the surface coating includes at least one of an electrolytically applied tin coating, a chromium/chromium oxide coating, an organic coating, an organic varnish, and a polymer film.

13. The packaging sheet metal product according to claim 1, wherein the mechanical parameters of the packaging sheet metal product are obtained by carrying out at least one of aging of the packaging sheet metal product and varnishing followed by drying of the packaging sheet metal product.

14. The packaging sheet metal product according to claim 4, wherein a total degree of cold rolling (GKWG) resulting from the thickness (d) of the packaging sheet metal product and a thickness (D) of the hot strip, defined as GKWG [total degree of cold rolling]=1−d/D, is at least 0.90.

15. The packaging sheet metal product according to claim 1, wherein the packaging sheet metal product is a singly or doubly reduced steel sheet having the thickness (d) in a range of 0.10 mm to 0.50 mm.

16. A packaging sheet metal product comprising a cold-rolled steel sheet having a thickness (of less than 0.6 mm, produced from a hot strip by single or double cold rolling of the hot strip at a reduction ratio of at least 80%, wherein the hot strip has a composition containing, in terms of weight:

C: 0.001-0.06%,
Si: <0.03%,
Mn: 0.17-0.5%,
P: <0.03%,
S: 0.001-0.03%,
Al: 0.001-0.1%,
N: <0.016%,
remainder iron, and unavoidable impurities,
and wherein the cold-rolled steel sheet is nitrogenized, in an annealing furnace in a presence of a nitrogen donor at a temperature of at least 550° C., to a nitrogen content of $\Delta N \geq 0.002\%$ relative to weight and recrystallization annealed at an annealing temperature of at least 630° C., then cooled to room temperature and finally cold-rolled at a final degree of rolling of 0.2% to 45% and then subjected to a biaxial deformation in a bulge test in a plastic range for characterization of deformation capacity, where the packing sheet metal product exhibits a lower yield stress ($Sb_{eL}$) of more than 300 MPa and a corresponding elongation at break (Ab) of more than 10%, as well as in a region between Lüders elongation ($Ab_e$) and an upper (plastic) elongation limit of $\varepsilon_{max}=0.5\cdot Ab\cdot(Sb_{eL}/Sb_m)$ exhibits a biaxial stress-strain diagram $\sigma_B(\varepsilon)$ that can be represented by function $\sigma_B=b\cdot\varepsilon^n$, where $\sigma_B$ is a true biaxial stress in MPa,
$\varepsilon$ is an amount of true elongation in a thickness direction in %,
$Sb_{eL}$ is a lower yield strength,
$Sb_m$ is an absolute strength,
$Ab_e$ is the Lüders elongation,
b is a proportionality factor, and
n is a strain-hardening exponent that satisfies $n \geq 0.353-5.1\cdot Sb_{eL}/10^4$ MPa.

17. The packaging sheet metal product according to claim 1, wherein a weight fraction of nitrogen of more than 0.004% is incorporated interstitially in steel of the packaging sheet metal product in unbonded form.

18. The packaging sheet metal product according to claim 4, wherein a final rolling temperature, during hot rolling of the steel slab, is in a range of 800° C. to 920° C. and the winding temperature, during winding of the hot strip, is in a range of 500° C. to 750° C.

19. The packaging sheet metal product according to claim 13, wherein the mechanical parameters of the packaging sheet metal product are obtained by carrying out aging of the packaging sheet metal product and wherein the aging is at least one of natural aging by storage over a predefined period of time and artificial aging by heat treatment over 20 to 30 minutes at an aging temperature in a range of 200° C. to 210° C.

20. The packaging sheet metal product according to claim 16, further comprising at least one of:

Cr: <0.1%,
Ni: <0.1%,
Cu: <0.1%,
Ti: <0.1%,
B: <0.005%,
Nb: <0.01%,
Mo: <0.02%, and
Sn: <0.03%, in terms of weight.

* * * * *